US010794601B1

(12) United States Patent
Sheehan

(10) Patent No.: US 10,794,601 B1
(45) Date of Patent: Oct. 6, 2020

(54) ADJUSTABLE CONVECTIVE HEAT CHAMBER APPARATUS AND METHOD OF USE

(71) Applicant: FastForm Research Ltd., Waterford (IE)

(72) Inventor: David Sheehan, Dunmore East (IE)

(73) Assignee: FastForm Research Ltd., Waterford (IE)

( * ) Notice: Subject to any disclaimer, the term of this patent is extended or adjusted under 35 U.S.C. 154(b) by 392 days.

(21) Appl. No.: 15/726,874

(22) Filed: Oct. 6, 2017

Related U.S. Application Data

(60) Provisional application No. 62/408,340, filed on Oct. 14, 2016.

(51) Int. Cl.
*F24C 15/32* (2006.01)
*F24C 15/16* (2006.01)
*F24C 15/08* (2006.01)

(52) U.S. Cl.
CPC ..... *F24C 15/325* (2013.01); *F24C 15/08* (2013.01); *F24C 15/16* (2013.01)

(58) Field of Classification Search
CPC .... F24C 1/16; F24C 7/10; F24C 15/16; F24C 15/168; F24C 15/325; F24C 15/322
USPC ..... 219/385, 386, 400, 392
See application file for complete search history.

(56) References Cited

U.S. PATENT DOCUMENTS 2,244,935 A * 6/1941 Binger ..... F24C 1/16 126/9 R
3,051,157 A * 8/1962 Rice ..... F24C 15/18 126/19 R
3,400,707 A * 9/1968 Owens ..... A47J 37/07 126/211
4,656,337 A * 4/1987 Lastofka ..... A47J 37/0635 126/275 E
4,780,596 A * 10/1988 Matsushima ..... F24C 15/325 126/21 A
5,038,497 A * 8/1991 Pelequin ..... F26B 9/003 34/202
5,687,940 A * 11/1997 England ..... A47C 3/38 248/188.2
9,239,168 B2 * 1/2016 Brunner ..... A47B 88/40
2006/0289427 A1 * 12/2006 Tidey ..... A47J 36/12 219/386
2010/0044362 A1 * 2/2010 Huang ..... F24C 7/06 219/392

* cited by examiner

*Primary Examiner* — Geoffrey S Evans
(74) *Attorney, Agent, or Firm* — Lodestone Legal Group; Jeromye V. Sartain

(57) ABSTRACT

A heat chamber apparatus comprises a base assembly, a lid assembly operably installed on the base assembly, and a rack assembly and heater assembly incorporated in the base and/or lid assemblies, the base and lid assemblies being optionally telescopically engaged for selectively adjusting the interior space of the heat chamber, and the rack assembly separating the interior space into first and second sub-chambers and being optionally pivotable for selectively accessing the sub-chambers.

21 Claims, 9 Drawing Sheets

ADJUSTABLE CONVECTIVE HEAT CHAMBER APPARATUS AND METHOD OF USE

RELATED APPLICATIONS

This non-provisional patent application claims priority pursuant to 35 U.S.C. § 119(e) to and is entitled to the filing date of U.S. Provisional Patent Application Ser. No. 62/408,340 filed Oct. 14, 2016, and entitled "Adjustable Convective Heat Chamber Apparatus and Method of Use." The contents of the aforementioned application is incorporated herein by reference.

BACKGROUND

The subject of this provisional patent application relates generally to convection ovens and the like, and more particularly to convective heat chambers configured for adjustment of one or more of the chamber size, the air flow path within the chamber, the number of sub-chambers within the chamber, and the orientation of the chamber.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, convection ovens or fan-assisted radiant heat ovens have been employed for decades. While conventional ovens typically rely on a radiant coil at the bottom of the oven and the fact that heat rises in order to heat the air and food or any other item within the oven, it is known that this can often result in uneven heating and significant temperature differences between the upper and lower areas in such conventional ovens. Accordingly, fan-assisted or convection ovens were introduced to circulate the air within the oven in an effort to reach more uniform temperatures throughout the oven's interior space. Related developments have addressed control of the fan so as to increase or decrease air flow as desired or even disable the fan at times. A large variety of configurations and placements of racks within the oven have also been proposed.

Ovens are employed in the healthcare industry in drying, curing, sterilizing and decontaminating applications in the medical device, optical, pharmaceutical and laboratory markets. Such ovens may include enhancements such as high temperature capability, air or nitrogen atmosphere, HEPA filters in convection oven contexts, conveyor and other automation incorporation, and other application-specific technologies. For the application of polymer coatings in medical instrument manufacturing, for example, forced convection ovens with tight temperature tolerances and forced exhaust are often selected for the coating drying process to achieve shorter cycle times and reduced cost. Such industrial convection ovens are often configured with horizontal and/or vertical recirculating airflows.

In the specific context of thermoformable materials or the process of warming materials to soften them and fit a prosthetic, for example, horizontal recirculating airflow ovens have been employed as have microwave ovens, infrared heaters, hot water baths, and other such technologies. However, the downsides of each relate to the need to size the heating device and chamber to the largest anticipated use, which combined with the typical size or footprint of such benchtop and other ovens, heaters, and baths results in a relatively large and cumbersome, limited use, and inconvenient addition to a lab, clinician's office or treatment room, or manufacturing facility. Relatedly, because the heated volume, be it an air or radiation chamber or a water bath, is essentially fixed, this often results in heating a much larger volume than the part or prosthetic would require as well limitations in utilizing any such additional volume to effectively heat multiple parts simultaneously. Therefore, what has been needed and heretofore unavailable is a versatile oven or the like that can efficiently and effectively heat a variety of sizes and quantities of thermoformable products in a single device. It will be appreciated that such a versatile oven or heat chamber and its related advantages may also have application in heating food products and a variety of other items, such that the exemplary context of thermoformable products is to be understood as illustrative and non-limiting.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a versatile, adjustable heat chamber apparatus. In at least one embodiment, the heat chamber apparatus comprises a base assembly, a lid assembly operably installed on the base assembly, and a rack assembly and heater assembly incorporated in the base and/or lid assemblies.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
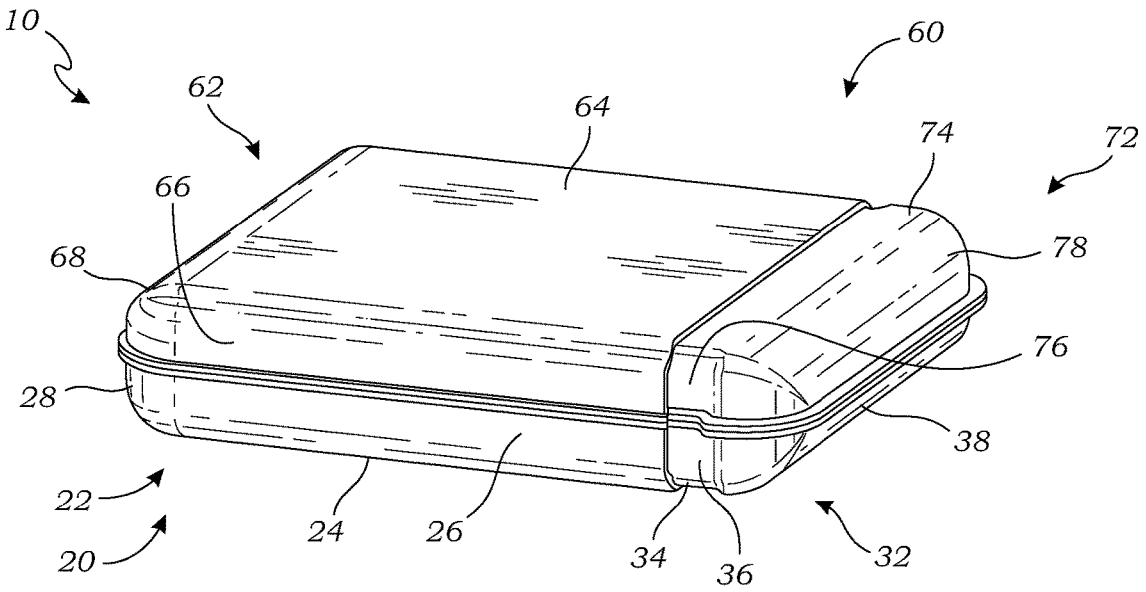
FIG. 1 is a perspective view of an exemplary heat chamber apparatus in a first operational mode, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of an apparatus according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of the claims.

Figure 2:
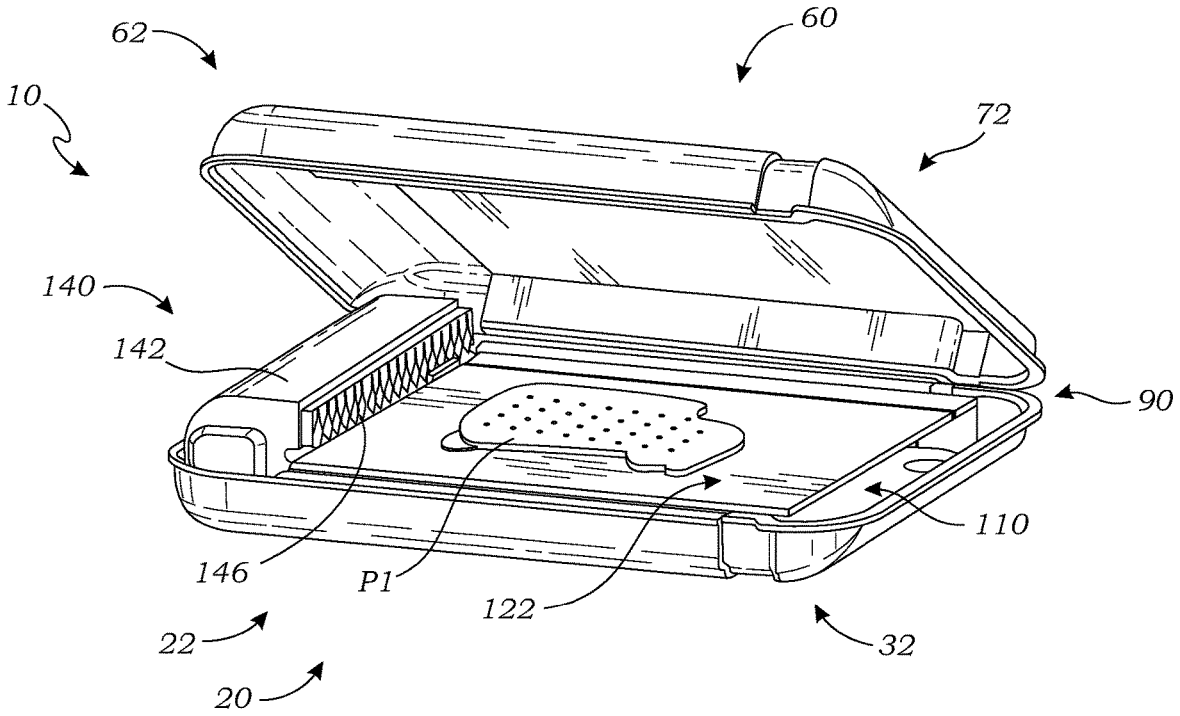
FIG. 2 is a perspective view thereof in a second operational mode, in accordance with at least one embodiment.

Turning now to FIGS. 1 and 2, there are shown perspective views of an exemplary embodiment of a heat chamber apparatus 10 according to aspects of the present invention in first and second operational modes (i.e., closed and opened, respectively), which discussion and the spatial relationships of the various components here assumes a substantially horizontal orientation of the apparatus 10, though it will be appreciated from the present disclosure that other orientations of such an apparatus 10 are possible according to aspects of the present invention without departing from its spirit and scope. The apparatus 10 comprises, in the exemplary embodiment, a lower base assembly 20 and an opposite upper lid assembly 60. As illustrated here, the base assembly 20 and the lid assembly 60 are pivotally engaged in a "clam shell" fashion along one edge as through a hinge assembly 90 or the like, though it is to be understood that other means of engagement thereof for selective access to the interior space of the heat chamber apparatus 10 are possible, as will be appreciated from the other alternative embodiments shown and described herein. The base assembly 20 generally comprises a first base enclosure 22 and a slidably or telescopically engaged second base enclosure 32, with each of the base enclosures 22, 32 having a bottom wall 24, 34 and upwardly turned side walls 26, 36 and end walls 28, 38 to form a generally upwardly-opening base assembly 20. Similarly, the lid assembly 60 generally comprises a first lid enclosure 62 and a slidably or telescopically engaged second lid enclosure 72, with each of the lid enclosures 62, 72 having a top wall 64, 74 and downwardly turned side walls 66, 76 and end walls 68, 78 to form a generally downwardly-opening lid assembly 60. The first base and lid enclosures 22, 62 are configured to engage and mirror one another as are the second base and lid enclosures 32, 72 in order to form the exemplary expandable or adjustable heat chamber apparatus 10. That is, as shown in FIG. 1 in the first operational mode with the heat chamber apparatus 10 closed, the first base side walls 26 and end wall 28 are configured to engage the respective first lid side walls 66 and end wall 68 and the second base side walls 36 and end wall 38 are configured to engage the respective second lid side walls 76 and end wall 78 so as to effectively seal off the interior space of the heat chamber apparatus 10 when closed in its illustrated first operational mode. Once more, the base and lid assemblies 20, 60 are joined along an edge by a hinge assembly 90, which assembly 90 may be configured as any means now known or later developed for pivotally joining two components, here as having one or more elements engaged with the base enclosures 22, 32, or the rear base side walls 26, 36 specifically, and corresponding one or more elements engaged with the lid enclosures 62, 72, or the rear lid side walls 66, 76 specifically. As best seen in FIG. 2 illustrating the heat chamber apparatus 10 opened or in its second operational mode as when the interior space is to be accessed to insert or remove a thermoformable product P1 as by lifting or pivoting the lid assembly 60 up relative to the base assembly 20, more about which is said below regarding the apparatus 10 in use, within the base assembly 20 there are also positioned a rack assembly 110 and a heater assembly 140, each of which is described in further detail below. First, the rack assembly 110 generally comprises a first rack 112 (FIG. 4) associated with the first base enclosure 22 and a second rack 122 associated with the second base enclosure 32 and slidably or telescopically engaged with the first rack 112 in much the same way that the second base enclosure 32 engages the first base enclosure 22. In that regard, those skilled in the art will appreciate that all such sliding or telescoping arrangements herein, whether as part of the base or lid assemblies 20, 60, the rack assembly 110, or otherwise, may comprise any tongue-and-groove, tube-in-tube, slotted or other mechanical arrangement, or any other such features now known or later developed for facilitating substantially linear or axial movement of one component relative to another. Relatedly, though not shown, such engaging or mating surfaces may be configured as any appropriate bearing surfaces with reduced friction whether based on material selection or treatment, the use of friction reducing additives, or the incorporation of mechanical devices such as bearings, linear slides or actuators, or the like, or any other such sliding means now known or later developed. As such, it will be appreciated that the illustrated engaging and sliding surfaces are merely exemplary and non-limiting. As shown by way of illustration and not limitation, a thermoformable product P1 may be placed on the rack assembly 110 and thereby heated upon operation of the heat chamber apparatus 10 as described herein. And with continued reference to FIG. 2, secondly, there is shown as included with the base assembly 20 a heater assembly 140 at one end. In the illustrated embodiment, the heater assembly 140 is positioned in conjunction with the first base enclosure 22 adjacent to the first base end wall 28, the heater assembly 140 having a housing 142 and an internal tangential or other such fan 144 (FIGS. 6 and 7) configured to blow air across or through a heater element 146 positioned in the opening of the housing 142 so as to circulate air throughout the heat chamber apparatus 10 during operation, more about which is again said below, particularly in connection with FIGS. 6 and 7. Here, it will be generally appreciated that warmed air leaving the heater assembly 140 would be directed over the rack assembly 110 and thus any thermoformable product P1 placed thereon during use.

Figure 3:
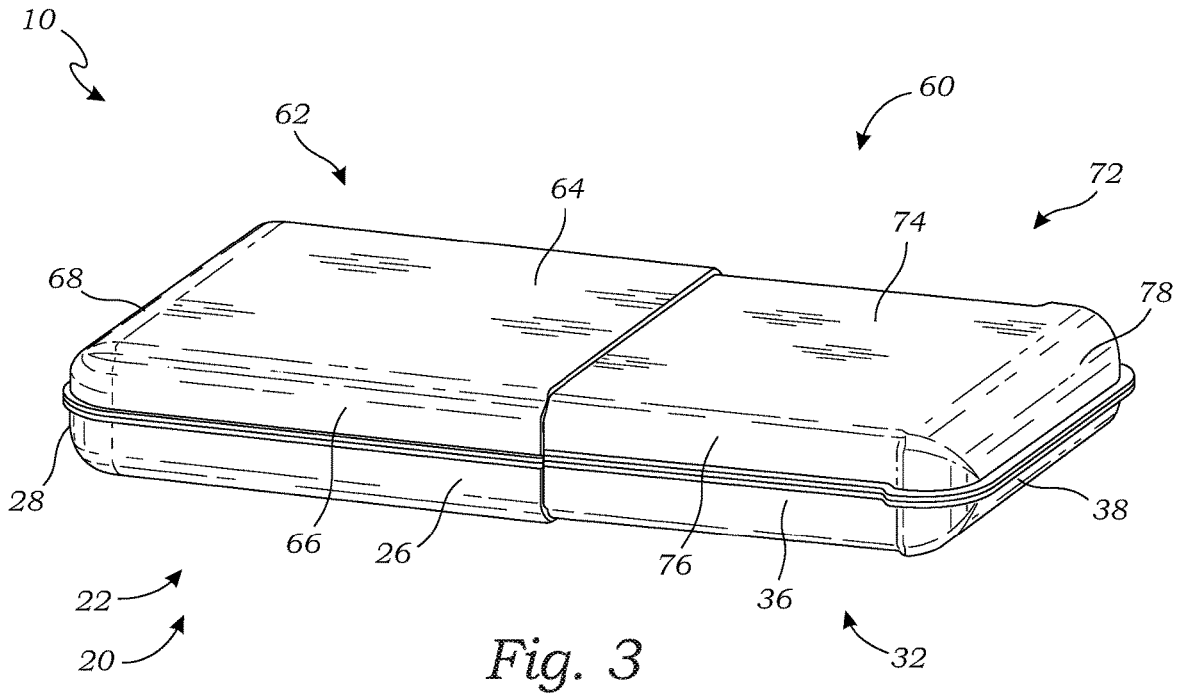
FIG. 3 is a perspective view thereof in a third operational mode, in accordance with at least one embodiment.
Figure 4:
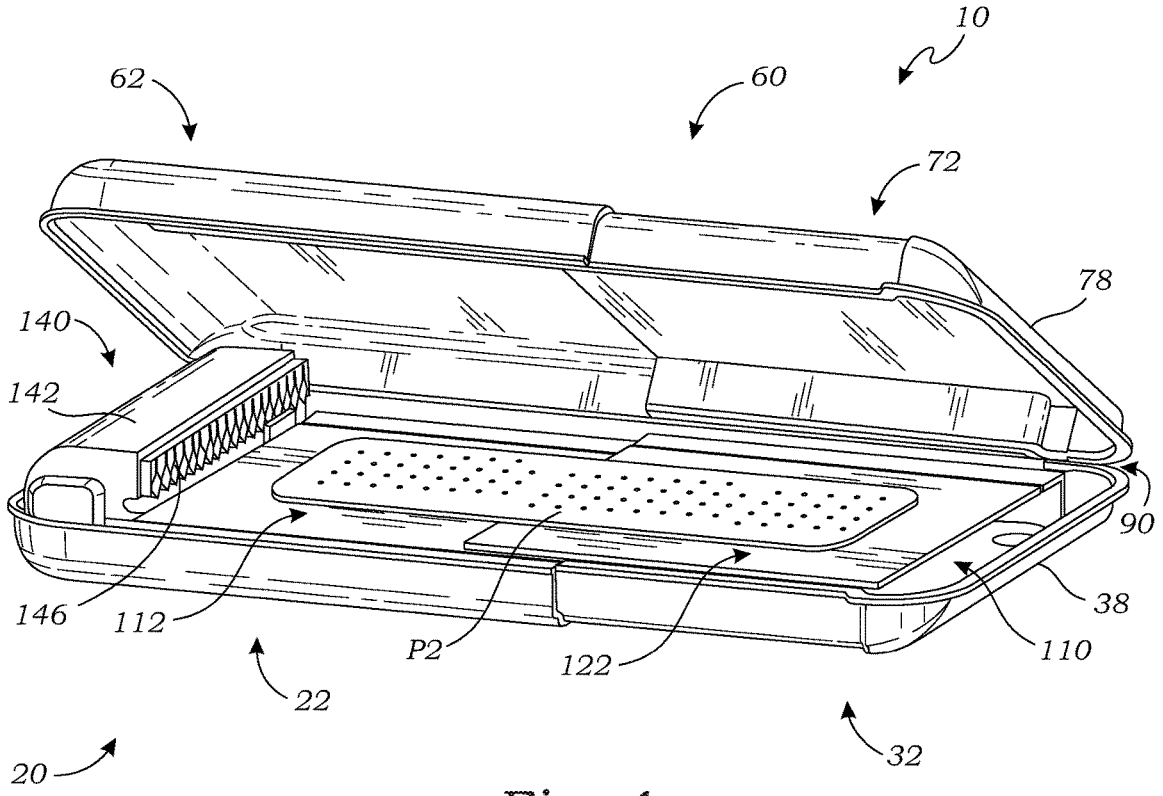
FIG. 4 is a perspective view thereof in a fourth operational mode, in accordance with at least one embodiment.
Figure 5:
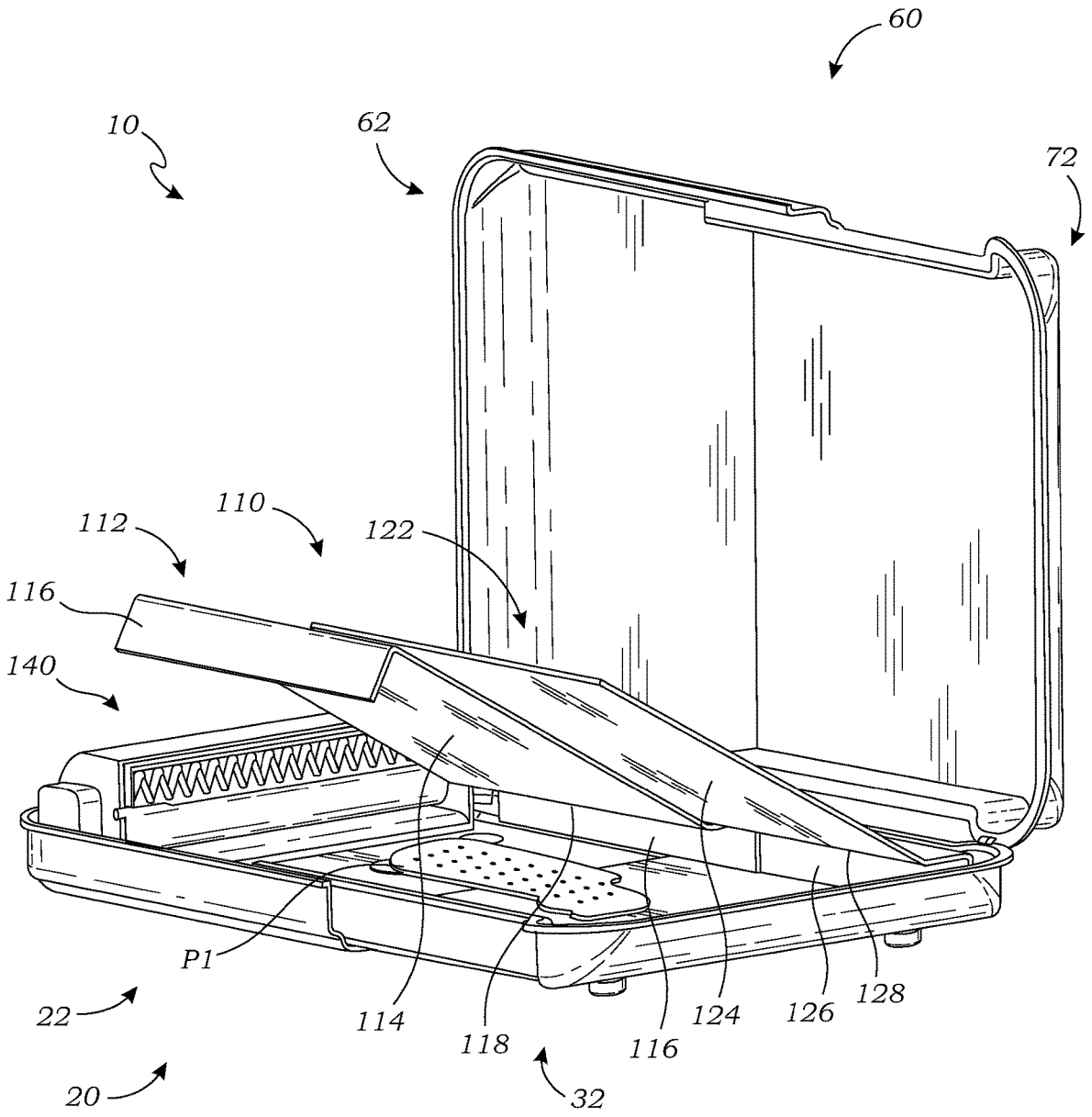
FIG. 5 is a perspective view thereof in a fifth operational mode, in accordance with at least one embodiment.

Referring next to the perspective views of FIGS. 3 and 4, there are shown the same exemplary heat chamber apparatus 10 of FIGS. 1 and 2, now in third and fourth operational modes (i.e., closed and open), respectively, with the apparatus 10 expanded as by shifting the second base and lid enclosures 32, 72 away from the first base and lid enclosures 22, 62 so as to elongate the apparatus 10 and thereby accommodate relatively larger or longer thermoformable products P2. As clearly seen in the expanded condition, the base assembly 20 again generally comprises a first base enclosure 22 and a slidably or telescopically engaged second base enclosure 32, with each of the base enclosures 22, 32 having upwardly turned side walls 26, 36 and end walls 28, 38, and the lid assembly 60 again generally comprises a first lid enclosure 62 and a slidably or telescopically engaged second lid enclosure 72, with each of the lid enclosures 62, 72 having a top wall 64, 74 and downwardly turned side walls 66, 76 and end walls 68, 78. In the exemplary embodiment, the configurations of the second base end wall 38 and of the second lid end wall 78, and more precisely the transition from such end walls 38, 78 to the respective second base and lid side walls 36, 76, forms an effective stop for insertion of the second base and lid enclosures 32, 72 within the respective first base and lid enclosures 22, 62. A similar stop feature may be formed internally in connection with extension of the second base and lid enclosures 32, 72 out of the respective first base and lid enclosures 22, 62. Those skilled in the art will appreciate that all such stops or other mechanical or other means for setting the travel stops on the second base and lid enclosures 32, 72 relative to the respective first base and lid enclosures 22, 62, whether now known or later developed, may be employed according to aspects of the present invention without departing from its spirit and scope. By way of illustration and not limitation, where a linear slide or bearing is employed in the engagements between the second base and lid enclosures 32, 72 and the respective first base and lid enclosures 22, 62, such would naturally provide fixed or adjustable travel stops in one or both directions. Internally, the heat chamber apparatus 10 once more further comprises an expandable or telescoping rack assembly 110 generally comprising a first rack 112 associated with the first base enclosure 22 and a second rack 122 associated with the second base enclosure 32 and slidably or telescopically engaged with the first rack 112. It will be appreciated that the size of the heat chamber interior space and the length of the flow path across the upper surface of the rack assembly 110 before turning at the end opposite the heater assembly 140 and returning along the lower surface of the rack assembly 110 is thus adjusted up and down by telescopically adjusting the relative positions of the first base and lid enclosures 22, 62 (effectively a first chamber sub-assembly) and the second base and lid enclosures 32, 72 (effectively a second chamber sub-assembly). In the exemplary embodiment the second base and lid enclosures 32, 72 (the second chamber sub-assembly) move as a unit. Moreover, the first rack 112 of the rack assembly 110 is spatially fixed relative to the first base and lid enclosures 22, 62 (the first chamber sub-assembly), while the second rack 122 of the rack assembly 110 is spatially fixed relative to the second base and lid enclosures 32, 72 (the second chamber sub-assembly); thus, in the illustrated embodiment, the first chamber sub-assembly effectively comprises the first base and lid enclosures 22, 62 and the first rack 112 and the second chamber sub-assembly effectively comprises the second base and lid enclosures 32, 72 and the second rack 122, each such sub-assembly moving in unison relative to the other. Those skilled in the art will appreciate that in alternative embodiments one or both of the first and second racks 112, 122 may move independently of the first base and lid enclosures 22, 62 and/or the second base and lid enclosures 32, 72 (the first and second sub-assemblies). Or in still other embodiments even the second base and lid enclosures 32, 72 may move independently of one another relative to the first base and lid enclosures 22, 62. It will be appreciated that in such embodiments with independently movable racks 112, 122 relative to the second base and lid enclosures 32, 72, both racks 112, 122 may be shifted to be overlapping, thereby shortening or collapsing the overall rack assembly 110, while the second base and lid enclosures 32, 72 may remain shifted outwardly relative to the first base and lid enclosures 22, 62 so as to create effectively a full chamber height heating zone at the end of the rack assembly 110 opposite the heater assembly 140 so as to enable reheating of a formed part that may not fit in either of the sub-chambers above or below the rack assembly 110 due to its increased height as a formed part. In a further embodiment, the second lid enclosure 72 may be attachable/detachable rather than telescoping and thus selectively installed when the chamber is to be expanded; in a still further embodiment, both the second base enclosure 32 and the second lid enclosure 72 are removably engaged with the respective first base enclosure 22 and first lid enclosure 62 to selectively expand or enlarge the heat chamber apparatus 10. Accordingly, the rack assembly 110 may be raised or lowered, or pivoted upwardly or downwardly, simultaneous with the second base and lid enclosures 32, 72 (second enclosure sub-assembly) being slid axially outwardly or inwardly relative to the first base and lid enclosures 22, 62 (first enclosure sub-assembly) so as to expand or contract, or lengthen or shorten, the apparatus 10. It will be appreciated that such is possible due to the interoperability of both the first and second base enclosures 22, 32 and first and second lid enclosures 32, 72, relative to themselves and to each other as being joined at a hinge assembly 90, and the first and second racks 112, 122 of the rack assembly 110. Again, a wide variety of components and means for selectively adjusting the overall size of the heat chamber apparatus 10, and particularly its interior space, are possible according to aspects of the present invention without departing from its spirit and scope. Further appreciation of these possibilities will be had from the below discussion in connection with additional exemplary alternative embodiments. More generally, it will be appreciated that such a heat chamber apparatus 10 according to aspects of the present invention allows for adjustment through a range of sizes of the interior space of the chamber, again as might be appropriate or preferable depending on the size of thermoformable product P1, P2 or other component(s) to be heated. In such telescoping engagement of the first base and lid enclosures 22, 62 (the first chamber sub-assembly) and the second base and lid enclosures 32, 72 (the second chamber sub-assembly), it is not necessary for a hermetic or airtight seal to be achieved between the sliding or engaging parts, just as that is not necessary between the base assembly 20 and the lid assembly 60 where the respective first base side walls 26 and end wall 28 engage the respective first lid side walls 66 and end wall 68 and the second base side walls 36 and end wall 38 engage the respective second lid side walls 76 and end wall 78—equilibrium within the chamber will nevertheless be reached as the warmed air is circulated. As shown, preferably the racks 112, 122 forming the rack assembly 110 will be substantially solid to further facilitate air movement or circulation throughout the chamber as herein described, though wire or other racks having perforations may also be employed without departing from the spirit and scope of the invention. As for the actuation of any hinging, or pivoting the lid assembly 60, or the first and second lid enclosures 62, 72 specifically, relative to the base assembly 20, or the first and second base enclosures 22, 32 specifically, the hinge assembly 90 employed in pivotally joining the second base and lid enclosures 32, 72 and the respective first base and lid enclosures 22, 62 along an edge in the exemplary embodiment comprises four components (not shown): a first base hinge element affixed to the first base enclosure 22; a first lid hinge element affixed to the first lid enclosure 62; a second base hinge element affixed to the second base enclosure 32; and a second lid hinge element affixed to the second lid enclosure 72. In practice, the first base and lid hinge elements are installed along adjacent edges of the respective first base and lid enclosures 22, 62 so as to pivotally connect them in effectively forming the first chamber sub-assembly discussed above, and the second base and lid hinge elements are installed along adjacent edges of the respective second base and lid enclosures 32, 72 so as to pivotally connect them in effectively forming the second chamber sub-assembly also discussed above, the resulting first and second chamber sub-assemblies slidably shifting relative to each other as units, whether in the "opened" or "closed" operational configurations as illustrated in FIGS. 2 and 4. In the exemplary embodiment, the first base and lid hinge elements may be relatively long so as to be installed substantially along the common edges of the respective "fixed" first base and lid enclosures 22, 62, and particularly at the lateral edges of the respective upwardly-extending first base side wall 26 and the downwardly-extending first lid side wall 66; whereas, the second base and lid hinge elements may be relatively short so as to be installed at the common edges of the respective "sliding" second base and lid enclosures 32, 72, which it will be appreciated enables support and pivotal connection of the second base and lid enclosures 32, 72, or the second chamber sub-assembly, while allowing it to slide within the respective first base and lid enclosures 22, 62, or the first chamber sub-assembly. As such, in the exemplary embodiment, the second base and lid hinge elements are to be installed specifically at the points on the second base and lid enclosures 32, 72 substantially where the second base and lid side walls 36, 76 and the second base and lid end walls 38, 78 meet or transition, as best seen in FIG. 5. Once more, those skilled in the art will appreciate that a variety of such hinge configurations and placements, now known or later developed, are possible according to aspects of the present invention without departing from its spirit and scope, as will be further appreciated from the alternative exemplary embodiment of FIGS. 8-10 discussed further below, and further that a virtually infinite variety of configurations or operational modes, intermediate or final, are thus possible according to aspects of the present invention without departing from its spirit and scope, the operational modes illustrated herein being understood as merely illustrative of such features and aspects and non-limiting. Once more, such can be achieved employing any appropriate technology or hardware now known or later developed.

Turning to the enlarged perspective view of FIG. 5, there is shown the exemplary heat chamber apparatus 10 of FIGS. 1-4 now in a fifth operational mode with the lid assembly 60 fully open or pivoted relative to the base assembly 20 and the rack assembly 110 pivoted up as well to reveal its movement and the sub-chamber beneath it where a second thermoformable product P1 may be placed to be warmed by the return air flowing around the end of the rack assembly 110, and the second rack 122 more specifically, opposite the heater assembly 140, between the second rack 122 and the second base and lid end walls 38, 78 (FIG. 4). As can be seen with reference to FIG. 5 along with FIG. 4, the rack assembly 110 again comprises a first rack 112 associated with the first base enclosure 22 and a second rack 122 associated with the second base enclosure 32 and slidably or telescopically engaged with the first rack 112. The first rack 112 itself comprises a first rack plate 114 having substantially perpendicular, downwardly-projecting first rack supports 116 and a first rack hinge 118 substantially parallel to and intermediate of the opposite, spaced apart first rack supports 116. Similarly, the second rack 122 comprises a second rack plate 124 having a substantially perpendicular, downwardly-projecting second rack support 126 and a second rack hinge 128 substantially parallel to and offset from the second rack support 126. In the exemplary embodiment the rear first and second rack supports 116, 126 are substantially parallel and configured to slide linearly relative to each other as the second base and lid enclosures 32, 72 (the second chamber sub-assembly) are slid telescopically relative to the first base and lid enclosures 22, 62 (the first chamber sub-assembly). Notably, again, in the illustrated embodiment, the first rack 112 thus has two spaced-apart first rack supports 116 while the second rack 122 has only one second rack support 126—it will be appreciated that such is not necessarily so and that other configurations and combinations of rack supports are possible. The first and second rack plates 114, 124 are substantially planar for providing smooth sliding surfaces relative to each other and a flat, even surface against which any product to be heated may rest. The first and second rack plates 114, 124 thus provide effectively an upper product support and set off an upper first sub-chamber from a lower second sub-chamber beneath the first and second rack plates 114, 124 thus allowing for the simultaneous heating of at least two products. While two such sub-chambers are thus formed as being separated by a single rack assembly 110, those skilled in the art will appreciate that a variety of other configurations through which other numbers of sub-chambers may be provided are also possible according to aspects of the present invention, such that the single rack assembly 110 with two sub-chambers formed thereby is to be understood as merely illustrative and non-limiting. For example, if two rack assemblies 110 were employed in a stacked fashion within the heat chamber apparatus 10, as by employing supports 116, 126 as shown, three heat sub-chambers would thus be provided. Once more, any number, configuration, and arrangement of such rack assemblies 110 may be incorporated in the heat chamber apparatus 10. And each rack assembly 110 may again have solid rack plates 114, 124 to further facilitate air movement or circulation throughout the chamber as herein described or wire racks or other perforated surfaces. Accordingly, a number of other configurations are possible beyond those shown and described, such that the exemplary embodiments are to be understood as illustrative of aspects of the present invention and non-limiting. No fasteners or other attachment means for the first and second racks 112, 122 relative to each other or to the first and second base enclosures 22, 62 are shown, as in the exemplary embodiment the racks 112, 122 may simply be placed and "float" in the first and second base enclosures 22, 62, being maintained in the generally desired position by form-fitting the "footprint" of the interior space of the first and second base enclosures 22, 62 and ultimately allowing movement of the racks 112, 122 independent of the base enclosures 22, 62. It will be appreciated that this allows for easy removal of the racks 112, 122 as needed and, in the case where the second chamber sub-assembly slides within the first chamber sub-assembly, further allows for the first rack supports 116 to slide over and along the second base bottom wall 34 as the second base enclosure 32 is shifted in or out relative to the first base enclosure 22 as well as the first and second rack supports 116, 126 to slide relative to each other. Though no fasteners or other attachment means are shown, it will be appreciated that in alternate embodiments, one or both of the racks 112, 122 may be effectively installed in or joined or affixed to the respective first and second base enclosures 22, 32, such as by fastening the adjacent first rack support 116 and first base side wall 26 and/or the second rack support 126 and the second base side wall 36 or by fastening the first and/or second rack supports 116, 126 to the respective first and/or second base bottom walls 24, 34, depending on the sliding arrangement of the enclosures 22, 32 and racks 112, 122 and other factors. In the exemplary embodiment of FIGS. 1-7, where it is desired that the rack assembly 110 effectively telescope or shift with the base and lid assemblies 20, 60, it will be appreciated that simply attaching or joining the second rack 122 to the second base enclosure 32, such as by affixing, again removably or permanently, the second rack support 126 to the adjacent second base side wall 36, will accomplish this functionality, with the first rack 112 effectively floating within the chamber or potentially being anchored along its end, for example. Again, other means of joining such components and causing their relative movement are possible according to aspects of the present invention, such that the exemplary embodiments are to be understood as illustrative and non-limiting. Any such fastening or affixing of any of the components within the heat chamber apparatus 10 may be temporary or permanent and may be achieved using any materials or techniques now known or later developed. More generally, regarding the materials and methods of construction of the exemplary heat chamber apparatus 10, the overall enclosure or body—i.e., the first and second base enclosures 22, 32 and the first and second lid enclosures 62, 72 in the illustrated embodiment—may be formed of any suitable material(s) now known or later developed, including but not limited to metals such as steel, aluminum, alloys, and the like in sheet or other form, a variety of plastics such as polypropylene, polystyrene, polyvinyl chloride ("PVC"), acrylonitrile butadiene styrene ("ABS"), polyethylenes such as high density polyethylene ("HDPE") and low density polyethylene ("LDPE"), polycarbonate, polyurethane, polyphenylsulfone ("PPSU"), polyetherketone ("PEK"), polyetheretherketone ("PEEK"), and other such plastics, thermoplastics, thermosetting polymers, and the like, or any combinations thereof, including sandwich structures employing any such metal or plastic materials as being sufficiently heat resistant along with a core or layer of insulation, including but not limited to relatively high temperature resistant polyisocyanurate ("PIR") foam insulation. Any such material selected may be of varying hardness or stiffness and other properties. Any appropriate manufacturing and/or assembly method now known or later developed may be employed in forming such heater components, in whole or in part, including but not limited to molding, forming, stamping, machining, bonding, welding, fastening, and the like. The rack assembly 110, and the first and second racks 112, 122 specifically, and other such components of the heater apparatus 10 may similarly be formed of any suitable material and by any suitable manufacturing and/or assembly method now known or later developed, with the rack plates 114, 124 particularly potentially being formed of sheet material that is perforated or mesh, wire, ribbed, ridged, or other such configuration to accommodate design parameters relating to air flow, surface contact with the products P1, P2 being heated, and other such factors. Dimensionally, it will be appreciated that the heat chamber apparatus 10 according to aspects of the present invention may take a virtually infinite range of sizes and configurations, and may be scaled up or down essentially as needed to suit a particular context. Here, there is illustrated first and second operational modes of the apparatus 10 in a substantially collapsed or intermediate state as in FIGS. 1, 2 and 5 configured to accommodate two relatively smaller thermoformable products P1 nominally measuring approximately 420 mm long by 460 mm wide, and in the illustrated third and fourth operational modes of the apparatus 10 in a substantially expanded state as in FIGS. 3 and 4 the apparatus 10 is configured to accommodate two relatively larger thermoformable products P2 nominally measuring approximately 800 mm long by 460 mm wide. Accordingly, in the exemplary embodiment, the heat chamber 10 itself as essentially being the distance along or length of the first base enclosure 22 is approximately 450 mm, expandable through a stroke of approximately 380 mm to arrive at an overall expanded length of approximately 830 mm. In either case, the nominal height of the heat chamber 10 from the first base bottom wall 24 to the first base top wall 30 is approximately 120 mm, such that each sub-chamber has a nominal height of approximately 60 mm. Again, other sizes and configurations are possible, such that these dimensions are to be understood as merely illustrative and non-limiting. By way of further illustration and not limitation, a nominal dimension of the heat chamber 10, whether fixed or expandable, may be on the order of 460 mm by 460 mm.

Figure 6:
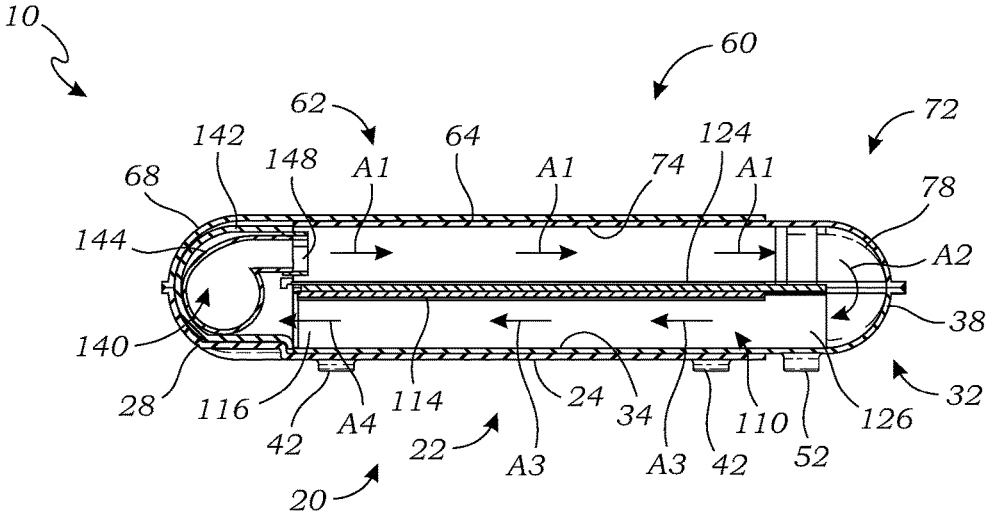
FIG. 6 is a side cross-sectional view thereof in the first operational mode of FIG. 1, in accordance with at least one embodiment.
Figure 7:
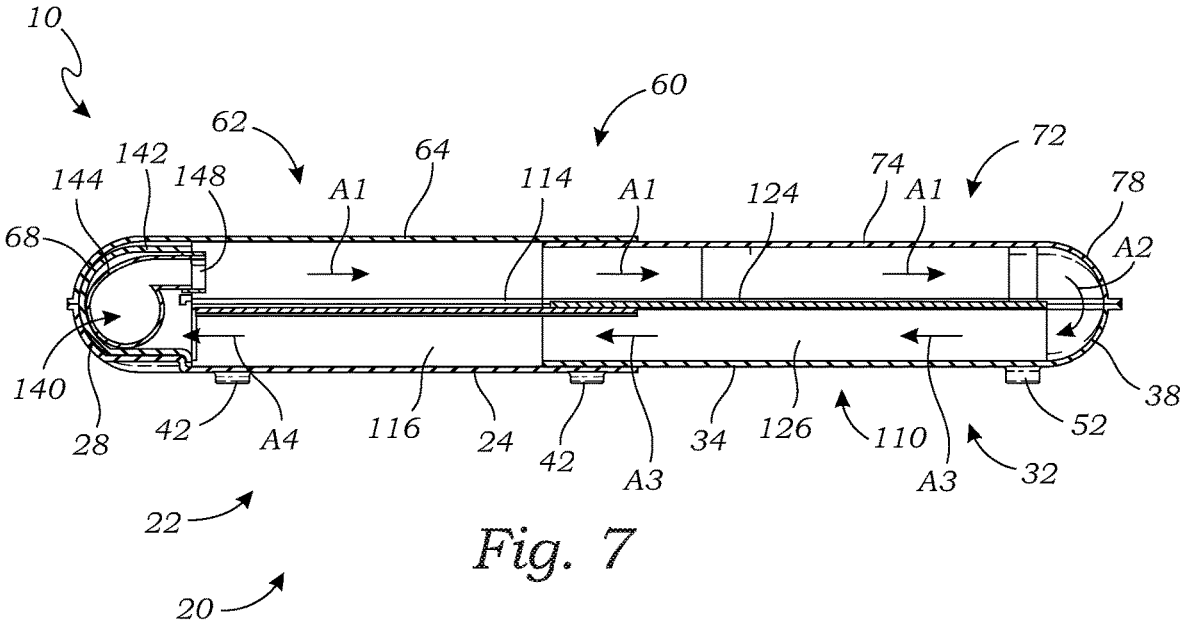
FIG. 7 is a side cross-sectional view thereof in the third operational mode of FIG. 3, in accordance with at least one embodiment.

Referring to FIGS. 6 and 7, there are shown side cross-sectional views of the exemplary heat chamber apparatus 10 of FIGS. 1-5 in its closed condition—FIG. 6 of the apparatus 10 in its relatively contracted or shortened first operational mode as illustrated in FIG. 1 and FIG. 7 of the apparatus 10 in its relatively expanded or lengthened third operational mode as illustrated in FIG. 3. In such side views there can be seen the vertical or layered relationships of the horizontal components within the heat chamber apparatus 10. Particularly, as for the interaction between the lower first base and second base enclosures 22, 32, it can be seen that the second base bottom wall 34 rides on top of or inside the first base bottom wall 24. Similarly regarding the interaction between the upper first lid and second lid enclosures 62, 72, it can be seen that the second lid top wall 74 rides beneath or inside the first lid top wall 64. And finally in the rack assembly 110 and the interaction between the first and second racks 112, 122 (FIGS. 4 and 5), it can be seen that the second rack plate 124 rides on top of the first rack plate 114. Once again, those skilled in the art will appreciate that other configurations and arrangements of the components of the heat chamber apparatus 10 are possible according to aspects of the present invention without departing from its spirit and scope. With continued reference to the side cross-sectional views of FIGS. 6 and 7, there is also shown first feet 42 formed on the first base enclosure 22 so as to extend substantially vertically downwardly from the first base bottom wall 24 thereof and second feet 52 formed on the second base enclosure 32 so as to extend substantially vertically downwardly from the second base bottom wall 34 thereof, which it will be appreciated serve to level and stabilize the heat chamber apparatus 10 on any underlying support surface, whether the apparatus 10 is in its contracted (FIGS. 1, 2 and 6) or expanded (FIGS. 3, 4 and 7) state. The side cross-sectional views also show the heater assembly 140, and particularly the heater housing 142, tucked inside the first base and lid end walls 28, 68 with the outlet 148 from the fan 144 directed into the upper sub-chamber or space above the rack assembly 110 and substantially parallel thereto so as to blow along the rack assembly 110 until the air is turned back under the rack assembly 110 by the opposite second base and lid end walls 38, 78, the heater element 146 itself (FIGS. 2 and 4) being removed here for simplicity. The heater assembly 140 may be removably or permanently installed within the unit, such as by being affixed to or engaged within the first base enclosure 22 in the vicinity of the first base end wall 28. For simplicity, no power or control features for the heater assembly 140 are shown, and those skilled in the art will appreciate that any such technologies now known or later developed may be employed. As for the heater element 146 itself, such may also entail any technology now known or later developed—in the exemplary embodiment a radiant element is shown; a filament or any other element capable of heating and over which air may be blown to facilitate convective heat transfer can be employed, and in alternative embodiments the air within the heat chamber apparatus 10 may be heated through other means separate from the fan 144, such as through an infrared heater, with the fan 144 then serving to circulate the warmed air to again encourage convective heat transfer and uniform heating of the thermoformable product P1, P2 or other part placed within the apparatus 10. Accordingly, it will be appreciated that in some embodiments, primary and secondary heating elements may be employed, such as by including an infrared heater and still having a radiant or filament heater element associated with the fan. In still other embodiments, the heater housing 142 may be incorporated into the first base and lid enclosures 22, 62, as by configuring the heater housing 142 to mirror the profile of effectively the first base end wall 28 of the first base enclosure 22 and nest thereon, such that the first lid enclosure 62 would simply not have a first lid end wall 68, instead the first lid top wall 64 seating substantially flush with the heater housing 142 when the heat chamber apparatus 10 is in its first operational mode or "closed" configuration as shown in FIGS. 1 and 2. Those skilled in the art will appreciate more generally that a heat chamber apparatus 10 according to aspects of the present invention in any such configuration conveniently allows for relatively easy adjustment of the size and number of chambers therein and thus of the air flow path therethrough, which can thus be accomplished in a variety of configurations without departing from the spirit and scope of the invention. Particularly, in terms of the airflow through the dual chamber apparatus 10 during operation of the heater assembly 140, it will be appreciated that whether the apparatus 10 is substantially in its collapsed state as generally illustrated in FIGS. 1, 2 and 6 or in an expanded state as generally illustrated in FIGS. 3, 4 and 7, those skilled in the art will appreciate that the same air flows and general operation of the heat chamber apparatus 10 apply, as well as for any other state or configuration therebetween or otherwise, consistent with the features and principles of aspects of the present invention as disclosed herein. Once more, the heater assembly 140 is configured with a tangential or other such fan 144 having an outlet 148 in which is positioned a heater element 146 (FIGS. 2 and 4), the heater 140 being configured such that the fan outlet 148 and heater element 146 over or through which the air blows during operation are aligned with or adjacent to the space above the rack assembly 110, so as to blow air first through a sub-chamber defined or bounded between the lid assembly 60, and more specifically the first and second lid enclosures 62, 72, above and the rack assembly 110, and more particularly the first and second rack plates 114, 124, below, as represented by arrows A1. Next, as the air reaches the opposite end of the chamber 10, it is forced to turn downward and then reverse direction below the rack assembly 110 as the air passes beyond the far edge of the rack assembly 110, or the second rack plate 124, particularly, and then follows the curved interior surfaces of the second lid end wall 78 and the second base end wall 38 as shown by arrows A2. The air then continues in a substantially reverse direction below the rack assembly 110 as compared to that above the rack assembly 110 illustrated by arrow A1, here the air as represented by arrows A3 passing through what is effectively a lower or second sub-chamber bounded above by the rack assembly 110 and below by the first and second base enclosures 22, 32, and the first and second base bottom walls 24, 34 more specifically. Finally, the air flow as indicated by arrows A4 leaves the lower second sub-chamber and reenters the heater assembly 140, and the fan 144 particularly, to be circulated again, and so on. Those skilled in the art will appreciate that there is thus provided within the heat chamber apparatus 10 an effective "closed loop" circulation system for the air therein. As such, as the air is warmed and returned for recirculation, relatively less work will be required by the heater assembly 140 to maintain a desired temperature; that is, even with the apparatus 10 not being air tight, it will be appreciated that it will reach somewhat of a thermal equilibrium over time, generally throughout the chamber 10, and particularly between the sub-chambers, subject to a number of factors such as the heater element's capacity, the ambient conditions, and the characteristics, number and size(s) of the part(s) to be heated, for example. Relatedly, though again not shown, the heat chamber apparatus 10 may be equipped with various controls and sensors for setting and maintaining a desired temperature, in the nature of a thermostat. It will once more be appreciated that a variety of configurations and related uses of the apparatus 10 are thus possible according to aspects of the present invention without departing from its spirit and scope, including but not limited to sizes and numbers of heating sub-chambers and their adjustability. It will be generally appreciated that the substantially clockwise flow of air through the chamber 10 (as viewed from the side in the illustrations) and the generally constant size of the flow channel, or its cross-section or profile, along with generously curved or rounded, relatively smooth walls throughout, all combines along with the operation of the tangential or other fan 144 itself to produce substantially laminar flow within the chamber 10, particularly once it has been running and reached somewhat equilibrium. By way of further example, one or both of the first and second racks 112, 122 may be sloped or slanted for potentially increased contact of the warmed air with the rack(s) 112, 122 and any thermoformable products P1, P2 (FIGS. 2, 4 and 5) or other item placed thereon.

Figure 8:
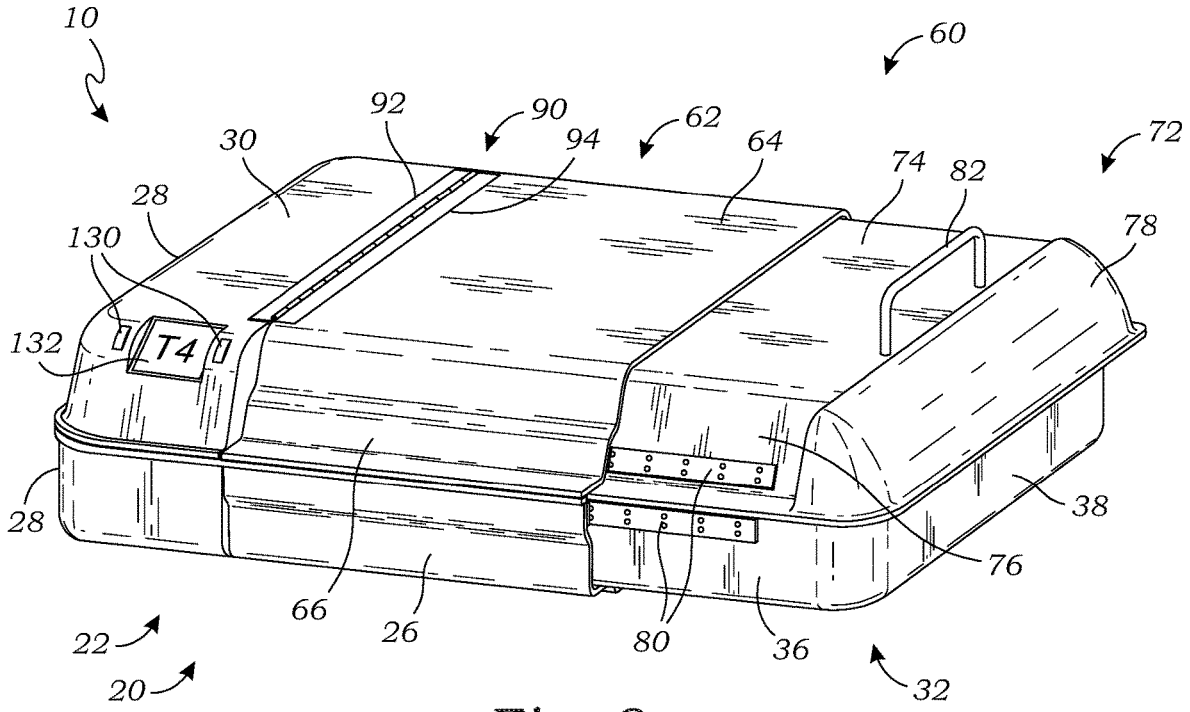
FIG. 8 is a perspective view of an alternative exemplary heat chamber apparatus in a first operational mode, in accordance with at least one embodiment.
Figure 9:
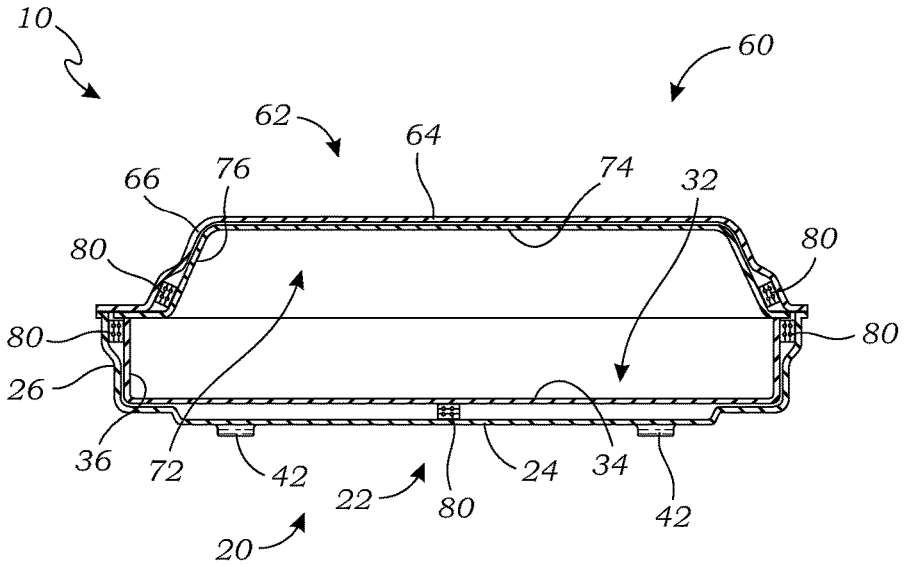
FIG. 9 is an end cross-sectional view thereof, in accordance with at least one embodiment.
Figure 10:
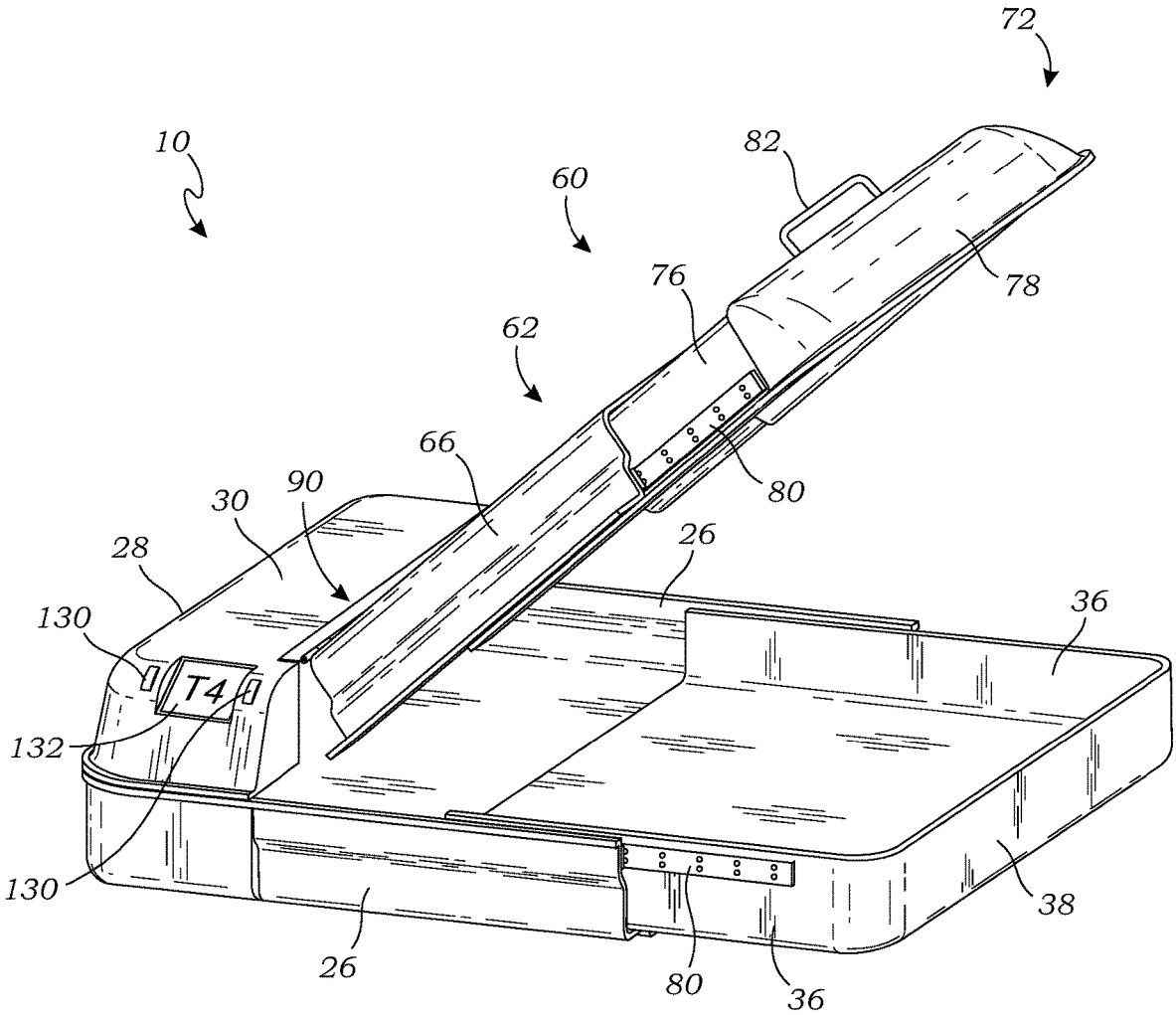
FIG. 10 is a perspective view thereof in a second operational mode, in accordance with at least one embodiment.

Referring next to FIGS. 8-10, there are shown perspective views of an alternative exemplary embodiment of a heat chamber apparatus 10 according to aspects of the present invention in first and second operational modes (i.e., closed and opened, respectively) as well as in section end-wise. The apparatus 10 is generally analogous to that of FIGS. 1-7 and so comprises, in the exemplary embodiment, a lower base assembly 20 and an opposite upper lid assembly 60. As illustrated, the lid assembly 60 is pivotally engaged on the base assembly 20 along an edge or axis that is here somewhat perpendicular to the direction of telescoping, as through a hinge assembly 90 or the like attached between the first lid enclosure 62, and the first lid top wall 64 specifically, and the first base enclosure 22, and the first base top wall 30 specifically, though it is to again be understood that other means of engagement thereof for selective access to the interior space of the heat chamber apparatus 10 are possible. In a bit more detail, the base assembly 20 generally comprises a first base enclosure 22 and a slidably or telescopically engaged second base enclosure 32, with each of the base enclosures 22, 32 having a bottom wall 24, 34 and upwardly turned side walls 26, 36 and end walls 28, 38 to form a generally upwardly-opening base assembly 20. Similarly, the lid assembly 60 generally comprises a first lid enclosure 62 and a slidably or telescopically engaged second lid enclosure 72, with each of the lid enclosures 62, 72 having a top wall 64, 74 and downwardly turned side walls 66, 76 and here a single second lid end wall 78 to form a generally downwardly-opening lid assembly 60, the opposite end of the lid assembly 60 associated with the first lid enclosure 62 being effectively enclosed by the first base end wall 28 extending from the first base bottom wall 24 to the first base top wall 30. The first base and lid enclosures 22, 62 are configured to again generally engage and mirror one another as are the second base and lid enclosures 32, 72 in order to form the exemplary expandable or adjustable heat chamber apparatus 10. That is, as shown in FIG. 8 in the first operational mode with the heat chamber apparatus 10 closed, the first base side walls 26 and end wall 28 are configured to engage the respective first lid side walls 66 and top wall 64 and the second base side walls 36 and end wall 38 are configured to engage the respective second lid side walls 76 and end wall 78 so as to effectively seal off the interior space of the heat chamber apparatus 10 when closed in its illustrated first operational mode. Once more, the base and lid assemblies 20, 60 are joined along a common edge by a hinge assembly 90, which assembly 90 may be configured as any means now known or later developed for pivotally joining two components, here as having a first base hinge element 92 engaged with the first base top wall 30 and a corresponding first lid hinge element 94 engaged with the first lid top wall 64. To facilitate the telescoping movement of the apparatus 10 as by shifting the second base and lid enclosures 32, 72 toward or away from the first base and lid enclosures 22, 62 so as to lengthen or shorten the apparatus 10 and expand or contract the volume within the chamber as explained herein, as best seen in the end cross-sectional view of FIG. 9, linear bearings 80 or the like may be provided as the fastening interface between the respective first and second base enclosures 22, 32 and the respective first and second lid enclosures 62, 72. More specifically, linear bearings 80 may be installed on the front and back of the apparatus 10 between the first base side walls 26 and the adjacent second base side walls 36 and between the first lid side walls 66 and the adjacent second lid side walls 76; optionally, one or more central linear bearing 80 may also be installed between the first base bottom wall 24 and the adjacent second base bottom wall 34. Again, those skilled in the art will appreciate that any such means for reduced friction rolling or sliding of one component relative to another, now known or later developed, may be employed in a heat chamber apparatus 10 according to aspects of the present invention without departing from its spirit and scope, such that the alternative exemplary embodiment of FIGS. 8-10 is to be understood as illustrative and non-limiting. Turning briefly to FIG. 10 illustrating the heat chamber apparatus 10 opened or in its second operational mode as when the interior space is to be accessed to insert or remove a thermoformable product or the like as by lifting or pivoting the lid assembly 60 up relative to the base assembly 20, it can be seen that by simply grasping the second lid enclosure 72 and lifting up relative to the second base enclosure 32 the second lid enclosure 72 can be pivoted off of the second base enclosure 32 about the hinge 90, again, here in a plane or along an axis substantially perpendicular to the lengthwise or telescoping axis of the heat chamber apparatus 10, rather than hinging parallel to or along such axis as in the exemplary embodiment of FIGS. 1-7. To further facilitate such movement of the lid assembly 60, a handle 82 may be provided on the second lid enclosure 72, here shown as installed on the second lid top wall 74, though it will be appreciated by those skilled in the art such a handle in any form now known or later developed may also be installed on other areas of the lid assembly 60. It will be further appreciated that the use of linear bearings 80 or other such mechanical means of sliding engagement facilitates not only the telescoping action of the chamber 10 but mechanical coupling of particularly the first and second lid enclosures 62, 72 so that the lid assembly 60 may move, or be pivoted, as a unit. Similarly, grasping the handle 82 or otherwise and sliding the second base and lid enclosures 32, 72 relative to the first base and lid enclosures 22, 62, and thus having such sub-assemblies move as units, is further facilitated by mechanical engagement of particularly the second lid enclosure 72 with the second base enclosure 32, which may be achieved employing any temporary fastening means now known or later developed, including but limited to mechanical catches, magnets, and the like. Back to FIG. 10 and the chamber 10 in its "open" configuration, with the lid assembly 60 thus pivoted up and out of the way, it will be appreciated that the interior of the heat chamber 10 may thus be accessed as needed in order to insert or remove a product to be heated. Though not shown here in FIG. 10 for simplicity, within the base assembly 20 there may again also be positioned a rack assembly 110 and a heater assembly 140, each of which is described in further detail herein and may take any form or configuration according to aspects of the present invention now known or later developed, typically operating in tandem to form two or more sub-chambers within the overall heat chamber 10 and a related flow path therethrough for circulating heated air as desired. With further reference to FIGS. 8 and 10, there is also shown as being incorporated into the base assembly 10 in the vicinity of the first base top wall 30 one or more controls 130 and a display 132 for selectively controlling or operating the heat chamber apparatus 10 during use, including but not limiting to setting heat temperature and time, for example. Those skilled in the art will appreciate that any such controls and displays now known or later developed may be employed according to aspects of the present invention and in virtually any suitable location on the heat chamber apparatus 10, such that the controls 130 and display 132 and their locations as shown and described are to be understood as illustrative and non-limiting. By way of further example, in accordance with aspects of the present invention and potentially in combination with any exemplary embodiment disclosed or suggested herein, a scanner (not shown) may be incorporated in the heater apparatus 10 to scan an RFID tag, Q-code, or any other such technology now known or later developed and applied to the product P1, P2 or its packaging so that the heat chamber apparatus 10 may then automatically select and operate at the correct heating profile for the product P1, P2. Such a scanner may again employ any technology now known or later developed and accordingly may be positioned in any appropriate location on or in the heater 10, including on the exterior for manual scanning of the product P1, P2 or within the enclosure for scanning of the product P1, P2 once placed therein. It will be appreciated that any such scanner may further offer other automation features in conjunction with operation of the heater 10, from product tracking as by lot number or serialization to even automatic adjustment of the chamber size and/or configuration and/or orientation depending on the type of product P1, P2 to be heater, as by employing servo motors or the like within the apparatus 10 for automatically expanding or contracting the telescoping chamber or adjusting its orientation as through the support assembly 150, for example. Again, those skilled in the art will appreciate that a variety of configurations of a heat chamber apparatus 10 according to aspects of the present invention for manual, semi-automatic, or automatic operation in one or more respects based on a number of factors are possible without departing from the spirit and scope of the invention.

Figure 11:
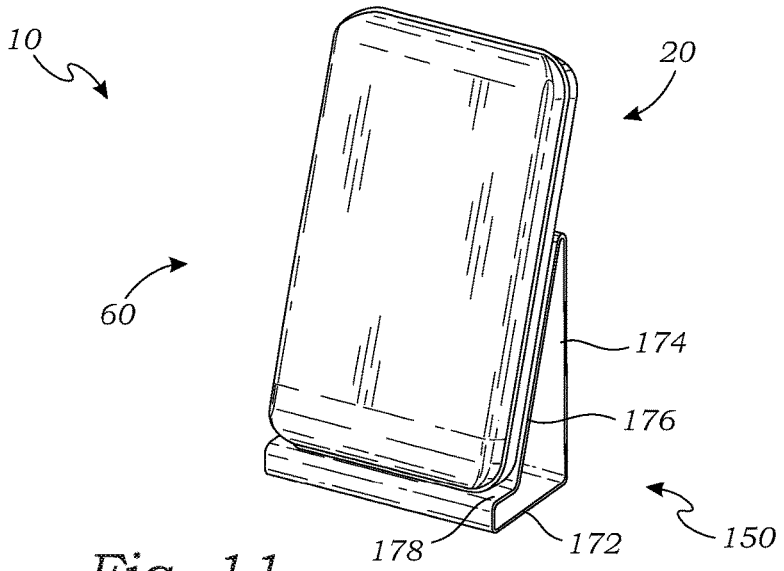
FIG. 11 is a perspective view of a further alternative exemplary heat chamber apparatus in a first operational mode, in accordance with at least one embodiment.
Figure 12:
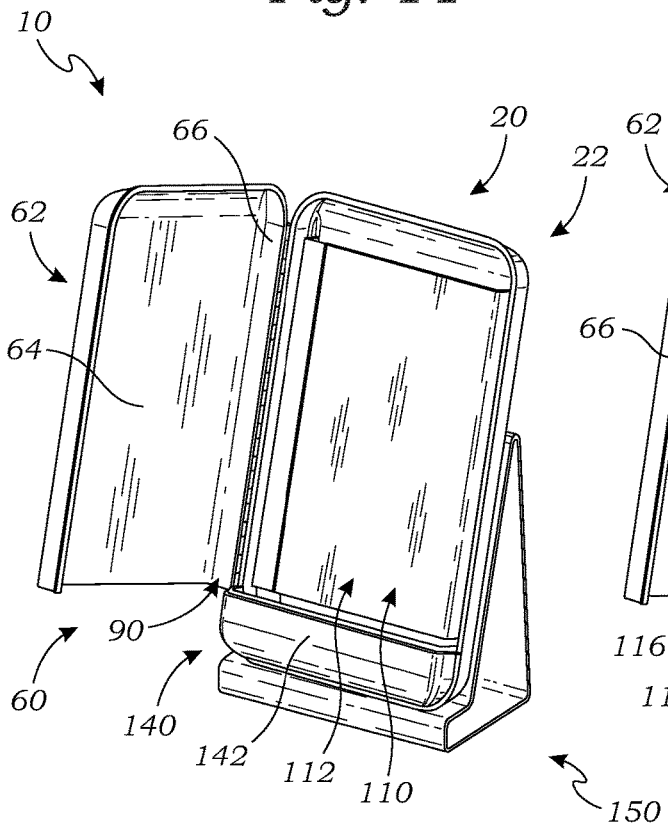
FIG. 12 is a perspective view thereof in a second operational mode, in accordance with at least one embodiment.
Figure 13:
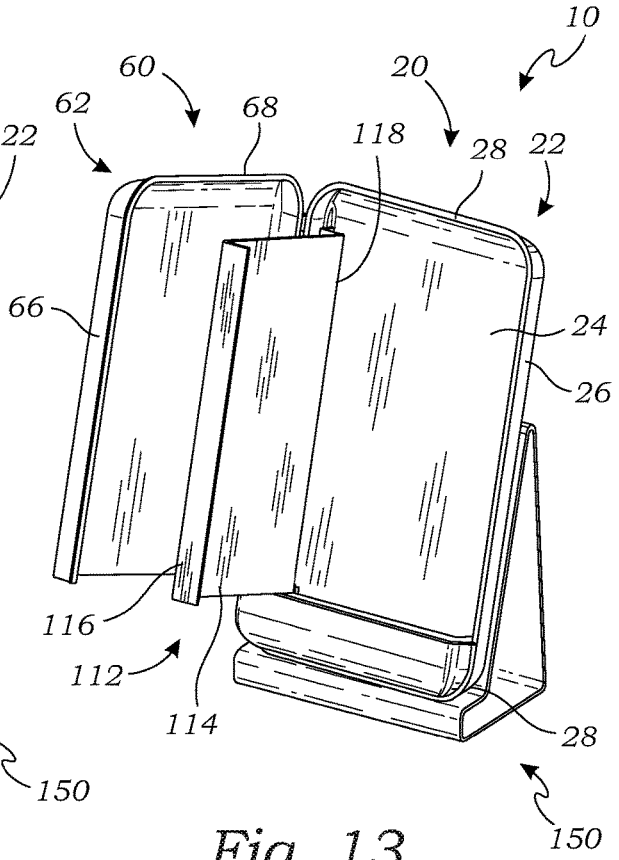
FIG. 13 is a perspective view thereof in a third operational mode, in accordance with at least one embodiment.

Turning to FIGS. 11-13, there are shown various views of an exemplary support assembly 150 employed in connection with a further exemplary heat chamber apparatus 10 according to aspects of the present invention, here in a scenario where it is desired to orient the apparatus 10 somewhat vertically, such as to reduce its "footprint" or the area occupied by it on a counter or the like. First, regarding the heat chamber apparatus 10, the alternative exemplary embodiment shown again generally comprises a rear or lower base assembly 20 and an opposite front or upper lid assembly 60, the base assembly 20 and the lid assembly 60 again being pivotally engaged in a "clam shell" fashion along one edge as through a hinge assembly 90 or the like, analogous to the embodiment of FIGS. 1-7. Notably, here the heat chamber apparatus 10 is shown as not telescoping, such that there is simply a unitary base assembly 20 having a base enclosure 22 comprising a base bottom wall 24 with outwardly- or upwardly-turned opposite base side walls 26 and end walls 28 and a similar unitary lid assembly 60 having a lid enclosure 62 comprising a lid top wall 64 with inwardly- or downwardly-turned opposite lid side walls 66 and an end wall 68, the opposite end being here occupied by the heater housing 142, such lid side and end walls 66, 68 being configured to substantially conform to or mirror the base side and end walls 26, 28 so that there is engagement when the lid or chamber is "closed." As in the exemplary embodiment of FIGS. 1-7, the hinge assembly 90 may be comprised of a base hinge element (not shown) installed along an edge of a base side wall 26 and a corresponding lid hinge element (not shown) installed along a respective edge of a lid side wall 66. Relatedly, with the heat chamber apparatus 10 here configured as non-telescoping, the rack assembly 110 is also substantially unitary, having a single rack 112 hinged on the same side as the outer enclosure hinge 90, though not necessarily so; that is, the rack 112 here comprises a rack plate 114 with opposite lengthwise rack supports 116 and an intermediate rack hinge 118 parallel to and offset from the rack supports 116. As such, it will be appreciated that by selectively pivoting the rack plate 114 about its hinge 118, the area beneath the rack plate 114 may be accessed so as to again enable heating of two separate thermoformable products P1, P2 (FIGS. 2, 4 and 5) as in other configurations of the heat chamber apparatus 10 according to aspects of the present invention. Moreover, with the heater assembly 140 again positioned at one end of the chamber 10, here the lower end as oriented somewhat vertically, and with its fan 144 (FIGS. 6 and 7) oriented so as to blow warm air over or on the top or outer side of the rack plate 114 and then return beneath the rack plate 114 after passing around the far end thereof as guided by the base and lid end walls 28, 68, the warm air will thus be circulated throughout the chamber, and particularly through the spaces on both sides of the rack plate 114 and thus through both sub-chambers where two different parts may be positioned. Those skilled in the art will appreciate that even oriented somewhat vertically, over the relatively short distances within the heat chamber apparatus 10, gravitational effects and the tendency of hot air to rise will be negligible or certainly easily overcome by the air flow velocity generated by the heater fan 144. With continued reference to FIGS. 11-13, to maintain the heat chamber apparatus 10 in the desired somewhat vertical orientation, there is again provided a support assembly 150 employed in conjunction therewith, here configured as an inclined stand or easel of sorts. The stand support assembly 150 generally comprises a stand base or bottom 172, a stand back 174, a stand incline 176 supported by the stand bottom 172 and back 174, and a stand ledge 178 adjacent to and extending outwardly from the stand incline 176. Though not shown, the stand support assembly 150, and the stand bottom 172 thereof particularly, may include feet or the like for stability and resisting sliding and/or wheels such as casters or the like, with or without a brake, to render the associated heat chamber apparatus 10 employed with the stand 150 selectively portable. When the heat chamber apparatus 10 is placed on the stand support assembly 150, essentially, its lower base end wall 28 seats on the stand ledge 178 and its back or bottom wall 24 rests against the stand incline 176. While the stand incline 176 is shown as being at a fixed angle relative to the stand bottom 172 and back 174, or the stand 150 is illustrated as being of unitary construction, it will be appreciated that it may also be configured in two or more parts or otherwise so as to be articulating or enable it to support a variety of sizes and shapes of the heat chamber apparatus 10, including telescoping versions as disclosed herein, and to enable the stand incline 176 and thus the apparatus 10 itself to be positioned at a variety of angles, which will be further appreciated in connection with the further alternative embodiment of FIGS. 14-16 discussed below. Once more, those skilled in the art will thus appreciate that the stand support assembly 150 may take a number of forms without departing from the spirit and scope of the invention, such that that disclosed is to be understood as merely illustrative and non-limiting.

Figure 14:
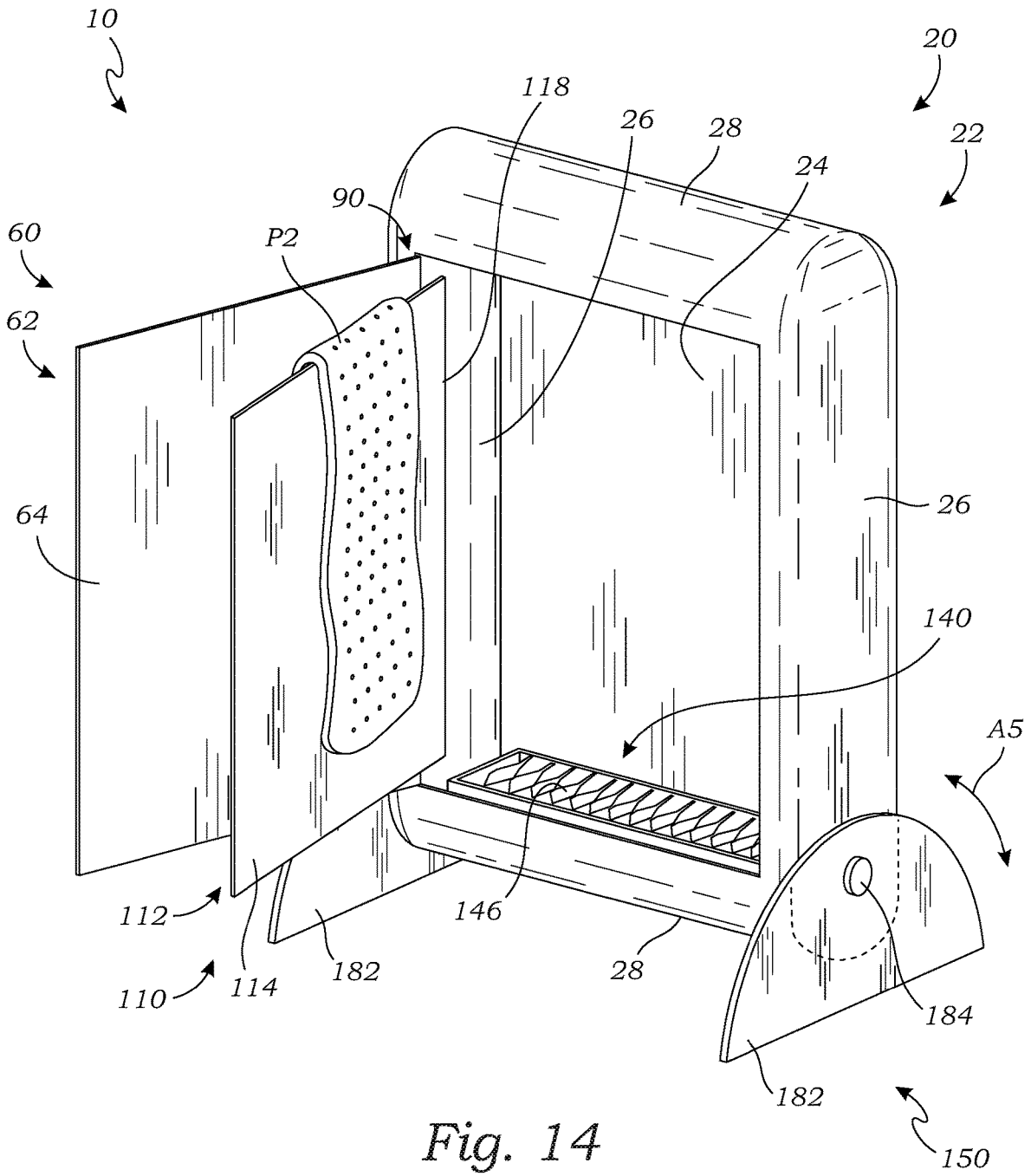
FIG. 14 is a perspective view of a further alternative exemplary heat chamber apparatus in a first operational mode, in accordance with at least one embodiment.
Figure 16:
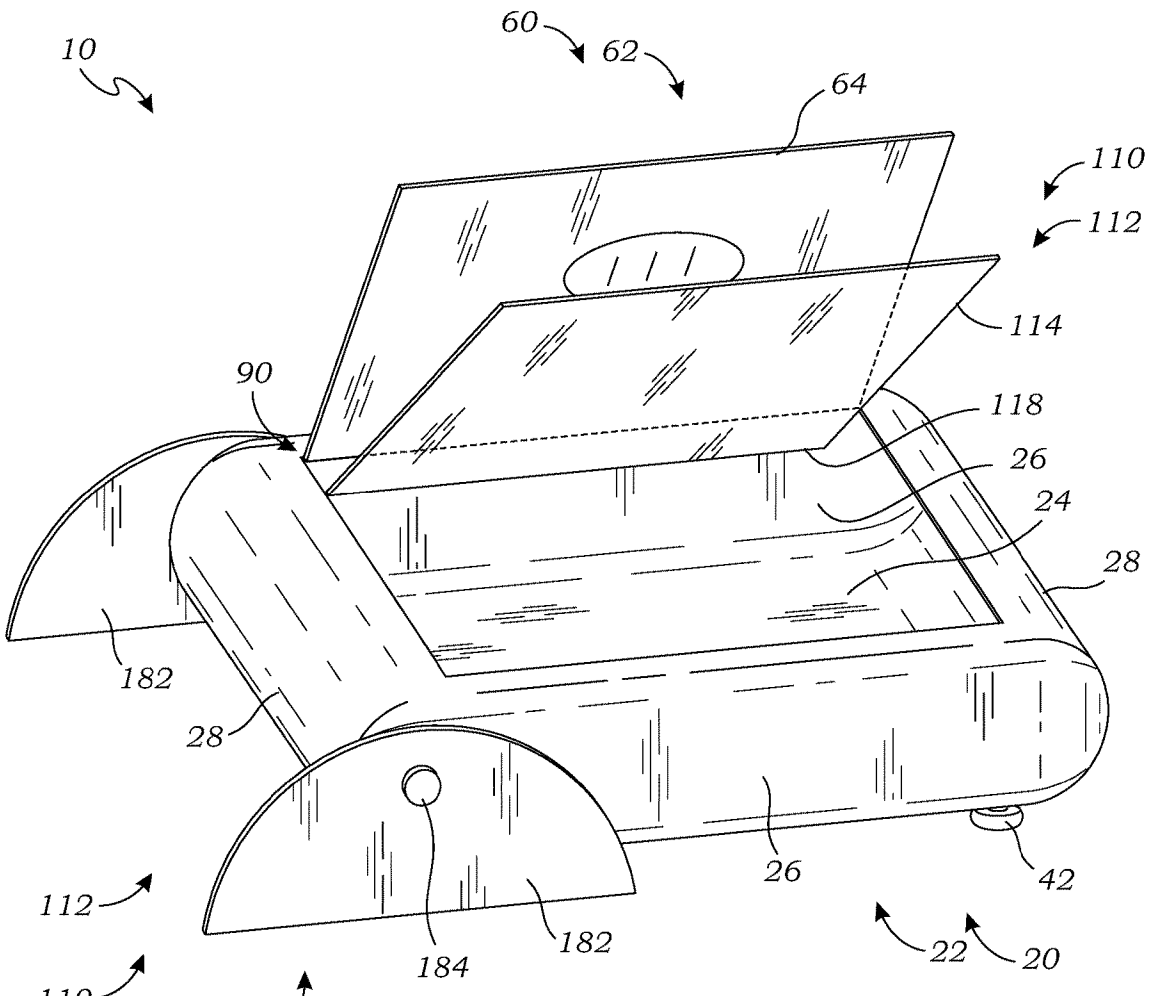
FIG. 16 is a perspective view thereof in a second operational mode, in accordance with at least one embodiment.
Figure 15:
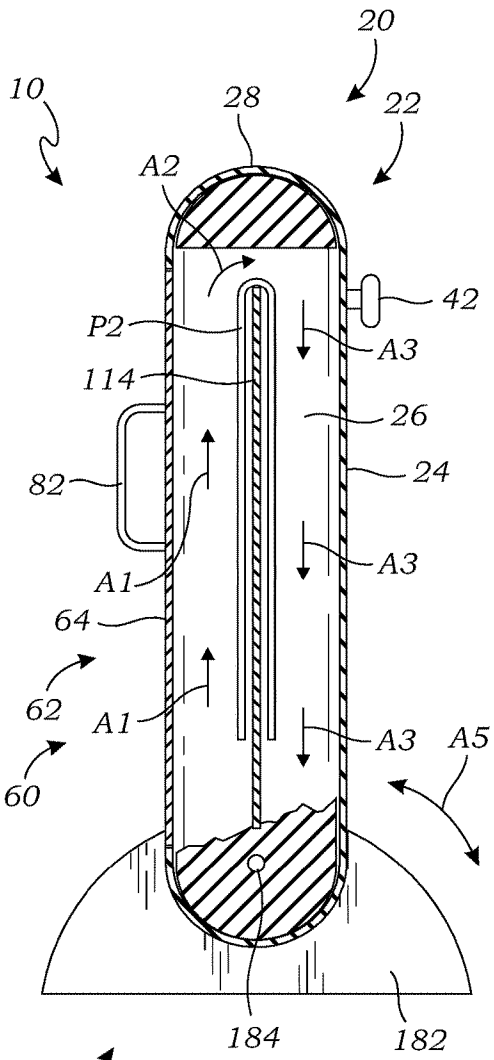
FIG. 15 is a side cross-sectional view thereof, in accordance with at least one embodiment.

Referring finally to FIGS. 14-16, there are shown perspective views of a further alternative exemplary embodiment of a heat chamber apparatus 10 according to aspects of the present invention in first and second operational modes (i.e., vertical orientation and horizontal orientation, respectively) as well as in side section, as being incorporated on or with an articulating stand or support assembly 150 so as to selectively place the apparatus 10 in a variety of positions or orientations. The apparatus 10 is here again non-telescoping and so is generally analogous to that of FIGS. 11-13 and so comprises, in the exemplary embodiment, a lower base assembly 20 and an opposite upper lid assembly 60. Those skilled in the art will appreciate that telescoping and other such configurations of the heat chamber apparatus 10 according to aspects of the present invention may also be employed in an arrangement as shown and described as including an articulating stand or support assembly 150, such that the presently illustrated non-telescoping apparatus 10 is to be understood as merely exemplary and non-limiting. As illustrated, the lid assembly 60 is pivotally engaged on the base assembly 20 along an edge as through a hinge assembly 90 (FIG. 12) or the like attached between the lid enclosure 62 and the base enclosure 22, though it is to again be understood that other means of engagement thereof for selective access to the interior space of the heat chamber apparatus 10 are possible. By way of further illustration and not limitation, the heater assembly 140 is again positioned at one end of the chamber 10, or at the lower end with the chamber 10 oriented substantially vertically as shown in FIGS. 14 and 15, with its fan 144 (FIGS. 6 and 7) oriented so as to blow warm air into one sub-chamber and receive return air from the other sub-chamber generally as herein disclosed. Regarding the rack assembly 110, with the heat chamber apparatus 10 once more here configured as non-telescoping, the rack assembly 110 may also be substantially unitary, having a single rack 112 hinged on the same side as the outer enclosure hinge 90, though not necessarily so. Here, the rack 112, and particularly the single rack plate 114, is shown as being pivotally installed on the inside surface of a base side wall 26 along an intermediate rack hinge 118, without any lengthwise rack supports 116 (FIG. 13). As such, it will be appreciated that one edge of the rack plate 114 may be supported by the structure of the base enclosure 22, whether integral or removably engaged therewith, with the opposite edge of the rack plate 114 being free as the rack plate 114 is pivoted about its hinge 118, with such free end being selectively supported on an opposite structure of the base enclosure 22 in any appropriate manner now known or later developed, particularly when the apparatus 10 is in a substantially horizontal orientation as illustrated in FIG. 16. The area beneath or behind the rack plate 114 may be accessed so as to again enable heating of two separate thermoformable products P1, P2 (FIGS. 2, 4 and 5) as in other configurations of the heat chamber apparatus 10 according to aspects of the present invention, particularly where the chamber 10 is oriented substantially horizontally, though even vertically such products may be suspended within the sub-chambers as desired employing hooks or other hardware as appropriate, or here with continued reference to FIGS. 14 and 15 illustrating the chamber apparatus 10 is a substantially vertical orientation, a single, relatively larger thermoformable product P2 may be draped over the rack plate 114 such that when the rack 114 is then pivoted inwardly so as to be received within the base enclosure 22 and the lid enclosure 62 is pivoted inwardly as well to "close" the chamber 10, a portion of the product P2 is positioned in the top or front sub-chamber along the top or front side of the plate 114 and the remainder or other portion of the product P2 is positioned in the bottom or back sub-chamber along the bottom or back side of the plate 114. It will again be appreciated that as warm air is then circulated via the fan 144, it will pass on the top or outer side of the rack plate 114 and then return beneath the rack plate 114 after passing around the far end thereof as guided by the base end wall 28, the warm air thus being circulated throughout the chamber 10, and particularly through the spaces on both sides of the rack plate 114 and thus through both sub-chambers where two different parts or one larger part may be positioned as herein described. Those skilled in the art will further appreciate that in the case of a single, relatively larger product P2 draped or folded over the rack plate 114, such product P2 may be formed with or naturally have a fold or "living hinge" as part of its design or may otherwise be configured or able to be folded somewhat as shown. Relatedly, it will be appreciated that the rack 112, and rack plate specifically 114, should have sufficient clearance between particularly its top edge, or the side opposite the heater assembly 140 in the exemplary embodiment, and the top or end wall 28 of the base enclosure 22 or other such structure so as to allow for the plate 114 to pivot in and out of the base enclosure 22 even with a product P2 draped thereover as shown. It should be noted at this juncture that for any thermoformable product having a polymer substrate, such substrate is preferably to not touch any parts of the heat chamber apparatus 10, whereas any liner pad affixed to such substrate in forming the thermoformable product may contact any such surfaces within the apparatus 10, it being a fabric or textile-based material not subject to sticking or adhering to any such oven or heat chamber surfaces. By way of illustration and not limitation, a representative two-layer (polymer substrate and liner) thermoformable product is disclosed in commonly owned U.S. Pat. No. 7,985,192, incorporated herein by reference. Even so, in alternate embodiments of the heat chamber apparatus 10 and/or of the products to be heated, contact with interior parts of the chamber 10 may be tolerated; particularly, the rack assembly 110 or portions thereof may be wire or otherwise configured or treated so as to allow contact therewith of heated parts without any appreciable adverse consequences. Moreover, in some applications a single-layer thermoformable product in the form of, for example, a thermoplastic sheet may be heated as by placing the product on a polytetrafluoroethylene (PTFE) sheet (e.g., Teflon® sheet) or the like, which "non-stick" sheet protects the product from any parts or surfaces within the heat chamber 10 and conveniently assists with the removal of the product from the chamber 10 after heating. Accordingly, a variety of thermoformable products beyond applicant's own products may be heated in a heat chamber apparatus 10 according to aspects of the present invention, including but not limited to those manufactured by North Coast (e.g., Omega Max®, Omega Plus® and Clinic® splinting material), Orfit (e.g., Orfilight® and Orfibrace® splinting material), and Patterson Medical/Rolyan Splinting (e.g., Sammons Preston®, Aquaplast®, Ezeform® and San-splint® splinting materials). Once again, products other than medical splint/cast/brace products, including foods and a variety of other items, may be safely, conveniently, and effectively heated in a heat chamber apparatus 10 according to aspects of the present invention as well. In any event, in the illustrated embodiment, the thermoformable product P2 is placed in the heat chamber 10 with its liner side down, against the rack plate 114. With the thermoformable product P2 in position, as shown in the side sectional view of FIG. 15, the rack assembly 110, and particularly the rack plate 114, is shifted inwardly as by again pivoting around the rack hinge 118 (FIGS. 14 and 16), thereby somewhat enclosing the thermoformable product P2. Next, the lid assembly 60 is closed as by pivoting the lid enclosure 62 until it is flush or engaged with the base enclosure 22 as illustrated, thereby fully enclosing the product P2 within the chamber 10. A handle 82 may be provided on the lid enclosure 62, and the lid top wall 64 specifically, to facilitate opening and closing the lid 62. Then, the chamber 10 is operated as set forth herein in order to heat and soften the product P2. Specifically, air from the fan 144 blows into the space above or in front of the rack assembly 110, or through a first sub-chamber defined or bounded between the lid assembly 60, and more specifically the lid enclosure 62, above or in front and the rack assembly 110, and more particularly the rack plate 114, below or behind, as represented by arrows A1. Next, as the air reaches the opposite end of the chamber 10, it is forced to turn downward and then reverse direction below or behind the rack assembly 110 as the air passes beyond the far edge of the rack assembly 110 and then follows the curved interior surface of the base end wall 28 as shown by arrow A2. The air then continues in a substantially reverse direction below or behind the rack assembly 110 as compared to that above or in front of the rack assembly 110 illustrated by arrow A1, here the air as represented by arrows A3 passing through what is effectively a lower or rearward second sub-chamber bounded above or in front by the rack assembly 110 and below or behind by the base enclosure 22, and the base bottom wall 24 more specifically. Those skilled in the art will further appreciate that by forming particularly the lid assembly 60, and more specifically the lid enclosure 62, of a clear material such as polycarbonate or heat resistant glass or any other such suitable material now known or later developed, in whole or in part, the parts placed within the chamber 10 can be observed during heating, though this of course is not necessary and is entirely optional.

With continued reference to FIGS. 14-16, the support assembly 150 is here shown as a pair of opposing support brackets 182 pivotally mounted on one end of the base enclosure 22, as by mounting the base enclosure 22 between the brackets 182 on a pivot rod 184 or the like. Those skilled in the art will appreciate that basically the base enclosure 22 of the base assembly 20, and the heat chamber apparatus 10 more generally, may thus selectively pivot from a first operative position as being substantially vertical as illustrated in FIGS. 14 and 15 to a second operative position as being substantially horizontal as illustrated in FIG. 16 as by simply shifting the apparatus 10 about the pivot rod 184 of the support assembly 150 on the support brackets 182, and vice versa, in the direction of arrow A5. It will be further appreciated that the support assembly 150, as part of the support brackets 182 and/or pivot rod 184 or otherwise, may selectively lock the heat chamber apparatus 10 in a desired position or orientation through any means now known or later developed, including but not limited to camming or ratcheting mechanisms, screws, bolts, pins, or other fastening devices, frictional or magnetic interfaces, etc. Any such mechanism may be configured such that the apparatus 10 may only pivot in one direction relative to the support base or brackets 182, or within one quadrant essentially, so as to prevent the apparatus 10 from being pivoted "upside down" with the lid assembly 60 facing down, for example. Relatedly, on the base bottom wall 24, one or more feet 42 may be provided somewhat opposite of or spaced from the support assembly 150, or the support brackets 182 and pivot rod 184, so as to support the free end of the apparatus 10 when it is pivoted to a substantially horizontal position. Such feet 42 may be adjustable, collapsible, or otherwise formed in any suitable configuration now known or later developed for selectively supporting a portion or end of the heat chamber apparatus 10 according to aspects thereof. Again, it will be appreciated that in a horizontal position multiple relatively free or separate products P1, P2 may be housed within the apparatus 10 for heating, while in the vertical position the apparatus 10 is optimally configured for heating relatively larger single products P2 even without the apparatus 10 being telescoping or expandable, as illustrated in FIGS. 14 and 15, in which vertical orientation it will be appreciated the apparatus 10 may also be stored when not in use having a relatively smaller "footprint." Though only substantially vertical and horizontal orientations are illustrated, it will be further appreciated that other positions of the apparatus 10 are also possible. More generally, those skilled in the art will appreciate that a virtually infinite variety of support hardware or assemblies 150 allowing for such selective pivoting and support of the heat chamber apparatus 10 are possible according to aspects of the present invention without departing from its spirit and scope, such that the exemplary support brackets 182 and pivot rod 184 are to be understood as illustrative and non-limiting. By way of further illustration and not limitation, the support brackets 182 and any other such hardware may be integral or unitary with the base enclosure 22 or separately formed and installed thereon, and whether permanently or temporarily or removably.

More generally, in connection with any of the embodiments herein described, it will be appreciated once more that while particular arrangements of the components of the heat chamber apparatus 10 are shown, particularly as to the base and lid assemblies 20, 60, the rack assembly 110, and the support assembly 150, the invention is not so limited. By way of further illustration and not limitation, in addition to the variability of the heat chamber or sub-chambers achieved through the telescoping interaction and functionality of the base and lid assemblies 20, 60 and/or the rack assembly 110, it is further possible that particularly the first and second racks 112, 122 of the rack assembly 110 may be shifted relative to one another to the extent that they no longer overlap, whereby a vertical wall or baffle may be inserted in the gap formed between them to define here a vertically and horizontally divided sub-chamber. As such, for example, when a relatively large product is to be heated the first and second racks 112, 122 may remain overlapping or substantially abutting so as to support the product and direct the air flow along its entire length before circling back beneath the rack assembly 110 to the heater assembly 140. Whereas when a relatively small to mid-size product is to be heated, the first and second racks 112, 122 of the rack assembly 110 may be shifted relative to one another even further apart so that they no longer overlap and a gap is formed therebetween into which a vertical wall or baffle may be inserted to separate or isolate the "in use" or "active" sub-chamber closest to the heater assembly 140 from the "inactive" outer sub-chamber. The active sub-chamber may still have two levels and so accommodate at least two parts as by configuring the vertical baffle to redirect the air flow down back the other direction beneath the rack assembly 110, whereby this approach effectively results in cutting the usable or "active" region within the heat chamber apparatus 10 substantially in half, sizing the working region better to the parts to be heated and rendering the apparatus 10 relatively more efficient by not heating unneeded space—that is, by reducing the air path length or the cavity or air volume being heated. Put another way, heating times can be reduced and thus efficiency increased by effectively scaling the chamber 10 to the part(s) being heated, thereby reducing the overall amount or volume to be heated and the related energy required. It will again be appreciated that a number of other such configurations are possible according to aspects of the present invention without departing from its spirit and scope. In a practical exemplary use, such a dual-chambered heater of any arrangement, or a heater having at least two sub-chambers, is thus well suited to splints and the like that comprise two parts, enabling the two parts to be heated or activated simultaneously and then applied to the patient by the clinician. By way of further illustration but not limitation, such may be accomplished even for relatively large parts such as the two sections of a thermoformable ankle foot orthosis ("AFO"). Those skilled in the art will appreciate that a heat chamber apparatus 10 according to aspects of the present invention may be put to a variety of other such uses, now known or later developed, without departing from its spirit and scope. It will be further appreciated that advantageously, in all such embodiments, the heater assembly 140—housing 142 and element 146—do not have to be removed or manipulated to access the heated part(s), which has obvious safety and convenience benefits. More generally, once again, those skilled in the art will appreciate that there is thus provided according to aspects of the present invention a new and improved heat chamber apparatus 10 that is adjustable as to one or more of the chamber size, the air flow path within the chamber, the number of sub-chambers within the chamber, and the orientation of the chamber, allowing for great versatility and efficiency in use as herein explained, with a relatively small heat chamber footprint even when simultaneously heating multiple parts. Put another way, according to aspects of the present invention in use, it will be appreciated that products P1, P2 are efficiently heated within such a heat chamber apparatus 10 in relatively shorter time and with relatively less energy, with the apparatus 10 occupying relatively less space during both use and storage. In the telescoping version of the heat chamber apparatus 10, such benefits in use are realized, at least in part, through the "net fit" adjustability of the chamber to the product(s) P1, P2 to be heated.

Aspects of the present specification may also be described as follows:

1. A heat chamber apparatus comprising: a base assembly having a first base enclosure; a lid assembly having a first lid enclosure configured for selective engagement with the first base enclosure, the first base and lid enclosures together selectively enclosing an interior space of the apparatus; a rack assembly having a first rack positioned within the apparatus so as to separate the interior space into first and second sub-chambers; and a heater assembly positioned within the apparatus adjacent to the rack assembly such that an outlet of the heater assembly is in communication with the first sub-chamber, whereby warmed air selectively discharged from the heater assembly flows through the first sub-chamber in a first direction and returns through the second sub-chamber in an opposite second direction.

2. The apparatus of embodiment 1 wherein: the first base enclosure comprises a first base bottom wall, opposite first base side walls connected with the first base bottom wall, and a first base end wall connected with the first base bottom wall and the opposite first base side walls; and the heater assembly is positioned between the first base end wall and the first rack of the rack assembly.

3. The apparatus of embodiment 2 wherein: the base assembly further comprises a second base end wall opposite the first base end wall; and clearance is provided between the rack assembly and the second base end wall opposite the heater assembly for passage therethrough of air from the first sub-chamber into the second sub-chamber.

4. The apparatus of embodiment 3 wherein the second base end wall is connected with the first base bottom wall and the opposite first base side walls so as to form a portion of the first base enclosure.

5. The apparatus of embodiment 4 wherein the first lid enclosure comprises a first lid top wall and opposite first lid side walls connected with the first lid top wall, whereby in selectively engaging the first lid enclosure with the first base enclosure the first lid side walls and the respective first base side walls are positioned substantially adjacent to each other and the first lid top wall and the first base bottom wall are positioned substantially opposite each other.

6. The apparatus of embodiment 5 wherein the first lid enclosure further comprises a second lid end wall connected with the first lid top wall and the opposite first lid side walls, whereby in selectively engaging the first lid enclosure with the first base enclosure the second lid end wall and the second base end wall are positioned substantially adjacent to each other.

7. The apparatus of any of embodiments 1-6 further comprising a hinge assembly interconnecting the base assembly and the lid assembly configured for selectively pivoting the lid assembly relative to the base assembly and thereby selectively opening and closing the apparatus.

8. The apparatus of embodiment 7 wherein the hinge assembly is positioned so as to connect the base and lid assemblies along adjoining respective first base and lid side walls.

9. The apparatus of embodiment 7 wherein the hinge assembly is positioned so as to connect the base and lid assemblies along adjoining respective second base and lid end walls.

10. The apparatus of embodiment 7 wherein: the first base enclosure further comprises a first base top wall connected with the first base end wall and the opposite first base side walls opposite of the first base bottom wall; and the hinge assembly is positioned so as connect the base and lid assemblies along the adjoining first base top wall and the first lid top wall.

11. The apparatus of embodiment 7 wherein: the first lid enclosure further comprises a first lid end wall connected with the first lid top wall and the opposite first lid side walls opposite of the second lid end wall; and the hinge assembly is positioned so as connect the base and lid assemblies along the adjoining first base end wall and the first lid end wall.

12. The apparatus of any of embodiments 4-11 wherein the first rack of the rack assembly comprises: a first rack plate positioned between the first and second sub-chambers; a first rack support for selective contact between the first rack plate and one or more of the first base bottom wall, the first base side wall, the first base end wall, and the second base end wall; and a first rack hinge formed on the first rack plate configured for selectively pivoting the first rack plate away from the first base bottom wall.

13. The apparatus of any of embodiments 3-12 wherein: the base assembly further comprises a second base enclosure telescopically engaged with the first base enclosure, the second base end wall being formed on the second base enclosure; and the lid assembly further comprises a second lid enclosure telescopically engaged with the first lid enclosure, whereby the interior space of the apparatus is selectively enclosed by the first and second base enclosures and the respective first and second lid enclosures and is selectively adjustable as by shifting the second base and lid enclosures relative to the respective first base and lid enclosures.

14. The apparatus of embodiment 13 wherein: the second base enclosure further comprises a second base bottom wall and opposite second base side walls connected with the second base bottom wall, the second base bottom wall being positioned adjacent to and shiftable relative to the first base bottom wall and the second base side walls being positioned adjacent to and shiftable relative to the respective opposite first base side walls; and the second base end wall is connected with the second base bottom wall and the opposite second base side walls.

15. The apparatus of embodiment 14 wherein: the first lid enclosure comprises a first lid top wall and opposite first lid side walls connected with the first lid top wall; and the second lid enclosure comprises a second lid top wall and opposite second lid side walls connected with the second lid top wall, the second lid top wall being positioned adjacent to and shiftable relative to the first lid top wall and the second lid side walls being positioned adjacent to and shiftable relative to the respective opposite first lid side walls.

16. The apparatus of embodiment 15 wherein a linear slide is installed between one or more of the first and second base side walls, the first and second base bottom walls, the first and second lid side walls, and the first and second lid top walls.

17. The apparatus of embodiment 15 or embodiment 16 wherein the first lid enclosure further comprises a first lid end wall connected with the first lid top wall and the opposite first lid side walls, whereby in selectively engaging the first lid enclosure with the first base enclosure the first lid side walls and the respective first base side walls and the first lid end wall and the respective first base end wall are positioned substantially adjacent to each other and the first lid top wall and the first base bottom wall are positioned substantially opposite each other.

18. The apparatus of any of embodiments 15-17 wherein the second lid enclosure further comprises a second lid end wall connected with the second lid top wall and the opposite second lid side walls, whereby in selectively engaging the second lid enclosure with the second base enclosure the second lid side walls and the respective second base side walls and the second lid end wall and the respective second base end wall are positioned substantially adjacent to each other and the second lid top wall and the second base bottom wall are positioned substantially opposite each other.

19. The apparatus of any of embodiments 14-18 wherein a plurality of first feet are formed on the first base bottom wall so as to extend therefrom and a plurality of second feet are formed on the second base bottom wall so as to extend therefrom in support of the base assembly.

20. The apparatus of any of embodiments 13-19 wherein the rack assembly further comprises a second rack telescopically engaged with the first rack.

21. The apparatus of embodiment 20 wherein: the first rack of the rack assembly comprises a first rack plate positioned between the first and second sub-chambers; and the second rack of the rack assembly comprises a second rack plate slidably received along the first rack plate.

22. The apparatus of embodiment 20 or embodiment 21 wherein the first rack further comprises a first rack support for selective contact between the first rack plate and one or more of the first base bottom wall, the second base bottom wall, the first base side wall, the second base side wall, and the first base end wall.

23. The apparatus of embodiment 21 or embodiment 22 wherein the second rack further comprises a second rack support for selective contact between the second rack plate and one or more of the first base bottom wall, the second base bottom wall, the first base side wall, the second base side wall, and the second base end wall, the second rack support slidably received along the first rack support.

24. The apparatus of any of embodiments 21-23 wherein: a first rack hinge is formed on the first rack plate configured for selectively pivoting the first rack plate away from the first base bottom wall; and a second rack hinge is formed on the second rack plate configured for selectively pivoting the second rack plate away from the second base bottom wall, whereby the first and second rack plates pivot in unison along the respective first and second rack hinges.

25. The apparatus of any of embodiments 20-24 wherein the telescopic movement of the second base and lid enclosures relative to the first base and lid enclosures is independent of the telescopic movement of the second rack relative to the first rack.

26. The apparatus of any of embodiments 13-25 wherein the telescopic movement of the second base and lid enclosures relative to the first base and lid enclosures is independent of the pivotal movement of the first and second lid enclosures relative to the first and second base enclosures.

27. The apparatus of any of embodiments 2-26 wherein a plurality of first feet are formed on the first base bottom wall so as to extend therefrom in support of the base assembly.

28. The apparatus of any of embodiments 1-27 wherein the heater assembly further comprises a housing and a fan operably installed therein so as to selectively blow air across a heater element positioned adjacent the outlet.

29. The apparatus of embodiment 28 wherein the housing is contained between the first base enclosure and the first lid enclosure.

30. The apparatus of embodiment 28 or embodiment 29 wherein the housing is contained in the first base enclosure so as to be exposed adjacent to and seat against the first lid enclosure opposite the first base enclosure.

31. The apparatus of any of embodiments 1-30 further comprising a support assembly positioned adjacent to the base assembly so as to selectively support the apparatus during use.

32. The apparatus of embodiment 31 wherein the support assembly comprises a stand incline against which at least a portion of the base assembly rests.

33. The apparatus of embodiment 32 wherein: the first base enclosure comprises a first base bottom wall and a first base end wall connected with the first base bottom wall; and at least a portion of the first base bottom wall rests against the stand incline and at least a portion of the first base end wall rests against a stand ledge formed adjacent to the stand incline.

34. The apparatus of embodiment 33 wherein the support assembly further comprises a substantially horizontal stand bottom and an adjacent stand back together operably engaged with the stand incline and the stand ledge.

35. The apparatus of any of embodiments 31-34 wherein the support assembly comprises at least one support bracket pivotally engaged with the base assembly.

36. The apparatus of embodiment 35 wherein: the first base enclosure comprises opposite first base side walls; and opposite support brackets are pivotally installed adjacent the respective opposite first base side walls via at least one pivot rod, whereby the apparatus may be selectively pivoted about an end of the base assembly from at least a substantially horizontal position to a substantially vertical position.

37. The apparatus of any of embodiments 31-36 wherein the support assembly is articulatable such that the apparatus may be selectively positioned in multiple orientations.

38. A method of employing a heat chamber apparatus as defined in any one of embodiments 1-37, the method comprising the steps of: opening the lid assembly of the apparatus relative to the base assembly so as to access the interior space of the apparatus; placing a first product or portion thereof in the first sub-chamber within the interior space of the apparatus and a second product or portion thereof in the second sub-chamber within the interior space of the apparatus separated from the first sub-chamber by the first rack of the rack assembly; and operating the heater assembly of the apparatus to selectively discharge warmed air through the first sub-chamber in a first direction and through the second sub-chamber in an opposite second direction and thereby warm the first and second products or portions thereof.

39. The method of embodiment 38, wherein the step of placing the second product or portion thereof in the second sub-chamber further comprises temporarily pivoting the first rack plate of the first rack about the first rack hinge formed on the first rack plate so as to access the second sub-chamber located behind the first rack.

40. The method of embodiment 38 or embodiment 39, further comprising the step of telescopically adjusting the size of the apparatus and thus of the first and second sub-chambers as by shifting the second base and lid enclosures relative to the first base and lid enclosures.

41. The method of embodiment 40, wherein the steps of opening the lid assembly and of shifting the second base and lid enclosures relative to the first base and lid enclosures may be performed independently and simultaneously.

42. The method of embodiment 40 or embodiment 41, wherein the steps of shifting the second base and lid enclosures relative to the first base and lid enclosures and of pivoting the first rack plate of the first rack so as to access the second sub-chamber located behind the first rack may be performed independently and simultaneously.

43. The method of any of embodiments 38-42, further comprising the step of articulating the apparatus relative to the support assembly supporting the apparatus such that the apparatus is selectively positioned in a desired orientation.

44. The method of embodiment 43, wherein the apparatus is selectively oriented substantially horizontally and contains two relatively smaller products, the first product positioned in the first sub-chamber and the second product positioned in the second sub-chamber.

45. The method of embodiment 43, wherein the apparatus is selectively oriented substantially vertically and contains one relatively larger product draped over the first rack, the first portion thereof positioned in the first sub-chamber and the second portion thereof positioned in the second sub-chamber.

46. The method of any of embodiments 38-45, further comprising the step of removably inserting a second rack assembly adjacent to the first rack assembly so as to accommodate additional products within the apparatus during use.

47. The method of any of embodiments 38-46, further comprising the step of separating the first and second racks so as to form a diverted air flow path from the first sub-chamber into the second sub-chamber.

48. A kit comprising a heat chamber apparatus as defined in any one of embodiments 1-37.

49. The kit of embodiment 48, further comprising a rack assembly removably inserted within the interior space of the apparatus.

50. The kit of embodiment 48 or embodiment 49, further comprising a support assembly configured to be positioned adjacent to the base assembly so as to selectively support the apparatus during use.

51. The kit of any of embodiments 48-50, further comprising instructional material.

52. The kit of embodiment 51, wherein the instructional material provides instructions on how to perform the method as defined in any one of embodiments 38-47.

53. Use of a heat chamber apparatus as defined in any one of embodiments 1-37 to warm one or more products as by adjusting one or more of the chamber size, the air flow path within the chamber, the number of sub-chambers within the chamber, and the orientation of the chamber.

54. The use of embodiment 53, wherein the use comprises a method as defined in any one of embodiments 38-47.

In closing, regarding the exemplary embodiments of the present invention as shown and described herein, it will be appreciated that a heat chamber apparatus is disclosed and configured for adjustment of one or more of the chamber size, the air flow path within the chamber, the number of sub-chambers within the chamber, and the orientation of the chamber. Because the principles of the invention may be practiced in a number of configurations beyond those shown and described, it is to be understood that the invention is not in any way limited by the exemplary embodiments, but is generally directed to a versatile heat chamber apparatus and is able to take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C and N, the text should be interpreted as requiring only one element from the group, not A plus N, or B plus N, etc.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with any appended claims here or in any patent application claiming the benefit hereof, and it is made clear that the inventor(s) believe that the claimed subject matter is the invention.

What is claimed is:

1. A heat chamber apparatus comprising:

a base assembly having a first base enclosure, the first base enclosure comprising a first base bottom wall, opposite first base side walls connected with the first base bottom wall, and a first base end wall connected with the first base bottom wall and the opposite first base side walls, the base assembly further having a second base end wall opposite the first base end wall;

a lid assembly having a first lid enclosure configured for selective engagement with the first base enclosure, the first base and lid enclosures together selectively enclosing an interior space of the apparatus;

a rack assembly having a first rack positioned within the apparatus so as to separate the interior space into first and second sub-chambers, the first rack comprising a first rack plate positioned between the first and second sub-chambers, a first rack support for selective contact between the first rack plate and one or more of the first base bottom wall, the first base side wall, the first base end wall, and the second base end wall, and a first rack hinge formed on the first rack plate configured for selectively pivoting the first rack plate away from the first base bottom wall; and a heater assembly positioned within the apparatus between the first base end wall and the first rack of the rack assembly such that an outlet of the heater assembly is in communication with the first sub-chamber, whereby clearance is provided between the rack assembly and the second base end wall opposite the heater assembly for passage therethrough of air from the first sub-chamber into the second sub-chamber such that warmed air selectively discharged from the heater assembly flows through the first sub-chamber in a first direction and returns through the second sub-chamber in an opposite second direction.

2. The apparatus of claim 1 wherein the second base end wall is connected with the first base bottom wall and the opposite first base side walls so as to form a portion of the first base enclosure.

3. The apparatus of claim 1 further comprising a hinge assembly interconnecting the base assembly and the lid assembly configured for selectively pivoting the lid assembly relative to the base assembly and thereby selectively opening and closing the apparatus.

4. The apparatus of claim 3 wherein the hinge assembly is positioned so as to connect the base and lid assemblies along adjoining respective first base and lid side walls.

5. The apparatus of claim 3 wherein:

the first base enclosure further comprises a first base top wall connected with the first base end wall and the opposite first base side walls opposite of the first base bottom wall; and the hinge assembly is positioned so as connect the base and lid assemblies along the adjoining first base top wall and the first lid top wall.

6. The apparatus of claim 1 wherein:

the base assembly further comprises a second base enclosure telescopically engaged with the first base enclosure, the second base end wall being formed on the second base enclosure; and the lid assembly further comprises a second lid enclosure telescopically engaged with the first lid enclosure, whereby the interior space of the apparatus is selectively enclosed by the first and second base enclosures and the respective first and second lid enclosures and is selectively adjustable as by shifting the second base and lid enclosures relative to the respective first base and lid enclosures.

7. The apparatus of claim 6 wherein the telescopic movement of the second base and lid enclosures relative to the first base and lid enclosures is independent of the pivotal movement of the first and second lid enclosures relative to the first and second base enclosures.

8. The apparatus of claim 6 wherein:

the second base enclosure further comprises a second base bottom wall and opposite second base side walls connected with the second base bottom wall, the second base bottom wall being positioned adjacent to and shiftable relative to the first base bottom wall and the second base side walls being positioned adjacent to and shiftable relative to the respective opposite first base side walls; and the second base end wall is connected with the second base bottom wall and the opposite second base side walls.

9. The apparatus of claim 8 wherein:

the first lid enclosure comprises a first lid top wall and opposite first lid side walls connected with the first lid top wall; and the second lid enclosure comprises a second lid top wall and opposite second lid side walls connected with the second lid top wall, the second lid top wall being positioned adjacent to and shiftable relative to the first lid top wall and the second lid side walls being positioned adjacent to and shiftable relative to the respective opposite first lid side walls.

10. The apparatus of claim 9 wherein a linear slide is installed between one or more of the first and second base side walls, the first and second base bottom walls, the first and second lid side walls, and the first and second lid top walls.

11. The apparatus of claim 9 further comprising a hinge assembly interconnecting the base assembly and the lid assembly configured for selectively pivoting the lid assembly relative to the base assembly and thereby selectively opening and closing the apparatus, wherein the hinge assembly is positioned so as to connect the base and lid assemblies along adjoining respective first base and lid side walls and respective second base and lid side walls.

12. The apparatus of claim 6 wherein the rack assembly further comprises a second rack telescopically engaged with the first rack.

13. The apparatus of claim 12 wherein:

the first rack of the rack assembly comprises a first rack plate positioned between the first and second sub-chambers; and the second rack of the rack assembly comprises a second rack plate slidably received along the first rack plate.

14. The apparatus of claim 13 wherein:

a first rack hinge is formed on the first rack plate configured for selectively pivoting the first rack plate away from the first base bottom wall; and a second rack hinge is formed on the second rack plate configured for selectively pivoting the second rack plate away from the second base bottom wall, whereby the first and second rack plates pivot in unison along the respective first and second rack hinges.

15. The apparatus of claim 12 wherein the telescopic movement of the second base and lid enclosures relative to the first base and lid enclosures is independent of the telescopic movement of the second rack relative to the first rack.

16. The apparatus of claim 1 further comprising a support assembly positioned adjacent to the base assembly so as to selectively support the apparatus during use.

17. The apparatus of claim 16 wherein the support assembly comprises a stand incline against which at least a portion of the base assembly rests.

18. The apparatus of claim 16 wherein the support assembly comprises at least one support bracket pivotally engaged with the base assembly.

19. The apparatus of claim 16 wherein the support assembly is articulatable such that the apparatus may be selectively positioned in multiple orientations.

20. A heat chamber apparatus comprising:

a base assembly having a first base enclosure and a second base enclosure telescopically engaged with the first base enclosure, the base assembly housing a heater assembly; and a lid assembly having a first lid enclosure and a second lid enclosure telescopically engaged with the first lid enclosure, the first lid enclosure configured for selective engagement with the first base enclosure and the second lid enclosure configured for selective engagement with the second base enclosure, whereby an interior space of the apparatus is selectively enclosed by the first and second base enclosures and the respective first and second lid enclosures and is selectively adjustable as by shifting the second base and lid enclosures relative to the respective first base and lid enclosures.

21. A heat chamber apparatus comprising:

a base assembly having a first base enclosure, the first base enclosure comprising a first base bottom wall, opposite first base side walls connected with the first base bottom wall, and a first base end wall connected with the first base bottom wall and the opposite first base side walls;

a lid assembly having a first lid enclosure configured for selective engagement with the first base enclosure, the first base and lid enclosures together selectively enclosing an interior space of the apparatus;

a rack assembly having a first rack positioned within the apparatus so as to separate the interior space into first and second sub-chambers, the first rack comprising a first rack plate positioned between the first and second sub-chambers, a first rack support for selective contact between the first rack plate and one or more of the first base bottom wall, the first base side wall, and the first base end wall, and a first rack hinge formed on the first rack plate configured for selectively pivoting the first rack plate away from the first base bottom wall; and a heater assembly positioned within the apparatus adjacent to the first rack of the rack assembly such that an outlet of the heater assembly is in communication with the first sub-chamber, whereby clearance is provided between the rack assembly and the first base end wall opposite the heater assembly for passage therethrough of air from the first sub-chamber into the second sub-chamber such that warmed air selectively discharged from the heater assembly flows through the first sub-chamber in a first direction and returns through the second sub-chamber in an opposite second direction.

* * * * *